US008427514B2

(12) United States Patent
Miura

(10) Patent No.: US 8,427,514 B2
(45) Date of Patent: Apr. 23, 2013

(54) DISPLAY APPARATUS, ELECTRONIC APPLIANCE, AND METHOD OF DRIVING DISPLAY APPARATUS

(75) Inventor: Kiwamu Miura, Kanagawa (JP)

(73) Assignee: Sony Corporation, Tokyo (JP)

( * ) Notice: Subject to any disclaimer, the term of this patent is extended or adjusted under 35 U.S.C. 154(b) by 217 days.

(21) Appl. No.: 13/064,608

(22) Filed: Apr. 4, 2011

(65) Prior Publication Data

US 2011/0273483 A1 Nov. 10, 2011

(30) Foreign Application Priority Data

May 7, 2010 (JP) ..... 2010-106922

(51) Int. Cl.
*G09G 5/10* (2006.01)

(52) U.S. Cl.
USPC ..... 345/690; 345/76; 345/77

(58) Field of Classification Search ..... 345/76, 345/77, 82, 87, 89, 204, 690; 315/383; 340/815.4, 340/815.55, 815.56; 358/1.9, 3.01, 3.02, 358/3.06
See application file for complete search history.

(56) References Cited

U.S. PATENT DOCUMENTS

2004/0108998 A1* 6/2004 Imamura ..... 345/204
2005/0007392 A1* 1/2005 Kasai et al. ..... 345/690
2005/0083270 A1* 4/2005 Miyazawa ..... 345/76
2007/0115224 A1* 5/2007 Yamamoto et al. ..... 345/76
2008/0030436 A1* 2/2008 Iida et al. ..... 345/77
2008/0117234 A1* 5/2008 Yajima et al. ..... 345/690
2008/0117235 A1* 5/2008 Morita ..... 345/690
2008/0158110 A1* 7/2008 Iida et al. ..... 345/76
2008/0165212 A1* 7/2008 Morita ..... 345/690
2009/0079767 A1* 3/2009 Morita ..... 345/690
2009/0096818 A1* 4/2009 Nishimura et al. ..... 345/690
2009/0160882 A1* 6/2009 Kiya et al. ..... 345/690
2010/0141626 A1* 6/2010 Tomida et al. ..... 345/211

FOREIGN PATENT DOCUMENTS

JP 2008-033193 A 2/2008

* cited by examiner

*Primary Examiner* — Joe H Cheng
(74) *Attorney, Agent, or Firm* — Rader, Fishman & Grauer PLLC

(57) ABSTRACT

A display apparatus includes: a display panel unit in which electro-optical devices that emit display light are arranged in the form of a matrix; and a control unit performing display grayscale control by sequentially selecting the electro-optical devices are arranged and driving the selected electro-optical devices in order with a first signal voltage and a second signal voltage based on an image signal, wherein the control unit divides a grayscale range that can be expressed by the second signal voltage into a plurality of areas and performs a grayscale interpolation operation for interpolating the display grayscales by the electro-optical devices by setting voltage values of the first signal voltage and the second signal voltage according to the grayscales of the image signal as commonly using respective setting information of the first signal voltage for each divided area of the second signal voltage.

8 Claims, 10 Drawing Sheets

(1) GRAYSCALE CONTROL (BASIS) ACCORDING TO EMBODIMENT (2) GRAYSCALE CONTROL (FIRST MODIFIED EXAMPLE) ACCORDING TO EMBODIMENT (3) GRAYSCALE CONTROL (SECOND MODIFIED EXAMPLE) ACCORDING TO EMBODIMENT (1) TELEVISION SET (2) DIGITAL CAMERA (2-1)

(2-2)

(1) NOTEBOOK TYPE PERSONAL COMPUTER (2) VIDEO CAMERA

DISPLAY APPARATUS, ELECTRONIC APPLIANCE, AND METHOD OF DRIVING DISPLAY APPARATUS

BACKGROUND OF THE INVENTION

1. Field of Invention

The present invention relates to a display apparatus having a display device (which is also called an electro-optical device), an electronic appliance having a display apparatus, and a method of driving a display apparatus. More particularly, the invention relates to control technology of display grayscales (configuration of grayscale control).

2. Description of the Related Art

There is a display apparatus which uses an electro-optical device, in which luminance is changed according to an applied voltage or a flowing current, as a pixel display device. For example, a representative example of an electro-optical device in which luminance is changed according to an applied voltage is a liquid crystal display device, and a representative example of an electro-optical device in which luminance is changed according to a flowing current is an organic electro luminescence device (an organic electro luminescence (organic EL), an organic light emitting diode (OLED); hereinafter referred to as an "organic EL"). An organic EL display apparatus using the latter organic EL device is a so-called self-luminous display apparatus using an electro-optical device that is a self-luminous device as a pixel display device.

The display apparatus using the electro-optical device may adopt a simple (passive) matrix method or an active matrix method as its driving method. However, the display apparatus of the simple matrix method has the problems that it is difficult to realize a large-scaled high-definition display apparatus having a simple structure.

Because of this, an active matrix method which controls a pixel signal that is supplied to a light-emitting device within a pixel using an active device installed within the pixel, for example, an insulated gate type field effect transistor (generally, a thin film transistor (TFT)), as a switching transistor has been actively developed.

In the case where the electro-optical device performs display, a switching transistor (sampling transistor) receives an input image signal that is supplied through an image signal line in a maintenance capacitance (which is also called a pixel capacitance) installed in a gate (control input terminal) of a driving transistor, and supplies a driving signal according to the received input image signal to the electro-optical device.

In the liquid crystal display apparatus using a liquid crystal display device as an electro-optical device, the liquid crystal display device is a voltage drive type device, and thus is driven just by a voltage signal according to the input image signal that is received in the maintenance capacitance. By contrast, in a display apparatus using a current drive type device such as an organic EL device as an electro-optical device, a driving transistor converts a driving signal (voltage signal) according to the input image signal that is received in the maintenance capacitance into a current signal, and supplies the driving current to an organic EL device or the like.

Here, it is known that a threshold voltage or mobility of an active device (driving transistor) that drives an electro-optical device is varied by a process change or the environment. Accordingly, in order to uniformly control the display luminance throughout the entire screen of the display apparatus, configurations for correcting the luminance change due to the characteristic change of the above-described active device for driving in each pixel circuit (driving signal constant processing technique for constantly maintaining the driving signal) have been variously examined.

SUMMARY OF THE INVENTION

However, in a general display apparatus, not limited to the organic EL display apparatus, in order to control the display grayscale of the display apparatus, the level of an image signal that drives the electro-optical device is simply controlled. However, according to this method, the display grayscale by the electro-optical device to the number of grayscales of the image signal is 1:1, and thus it is necessary to increase the number of grayscales that corresponds to the image signal in order to increase the number of display grayscales. In other words, it is necessary to increase the number grayscales that corresponds to an output driver of the image signal, and this causes a cost increase. On the contrary, if the number of grayscales of the image signal is reduced to keep the cost of the output driver down, the number of display grayscales by the electro-optical device is also reduced, and in the case of simply reducing the number of expressible grayscales, the display image quality deteriorates accordingly.

As described above, in the grayscale control technology in the related art, it is not satisfactory to extend the number of display grayscales while seeking both cost reduction and image quality.

Accordingly, it is desirable to provide a configuration capable of extending the number of display grayscales while seeking both cost reduction and image quality.

According to an embodiment of the invention, the display grayscale control is performed by sequentially selecting electro-optical devices in a display panel unit in which the electro-optical devices that emit display light are arranged in the form of a matrix and by driving the selected electro-optical devices in order with a first signal voltage and a second signal voltage based on an image signal.

In the display grayscale control, a grayscale range that may be expressed by the second signal voltage is divided into a plurality of areas, and a grayscale interpolation operation for interpolating the display grayscale by the electro-optical device by setting the voltage values of the first signal voltage and the second signal voltage according to the grayscales of the image signal as commonly using respective setting information of the first signal voltage for each divided area of the second signal voltage.

According to the embodiment of the invention as described above, during the display driving by the electro-optical device, by setting the voltage values of the first signal voltage and the second signal voltage, respectively, according to the grayscales of the image signal, the grayscale interpolation operation for interpolating the display grayscales in the respective electro-optical devices is performed. Accordingly, the expression of the grayscales, the number of which is larger than the number of grayscales of which the original setting is possible through the image signal, is realized. Accordingly, the configuration of the driving circuit is simplified (not complicated) and high-definition grayscale expression is performed.

Further, according to the embodiment of the invention, a grayscale range that may be expressed by the second signal voltage is divided into a plurality of areas, and setting information of the first signal voltage that is used for grayscale interpolation is commonly used for each divided area of the second signal voltage. It is not necessary to prepare the setting information of the first signal voltage with respect to all second signal voltage values, and common setting information may be used for each area. Accordingly, the storage amount of setting information of the first signal voltage is reduced as compared with a case where the setting information of the first signal voltage is prepared with respect to all the second signal voltage values.

According to the embodiment of the invention, it is possible to realize the expression of grayscales the number of which is larger than the number of grayscales of which the original setting is possible through the image signal while seeking both cost reduction and image quality.

DESCRIPTION OF THE PREFERRED EMBODIMENTS

Figure 1:
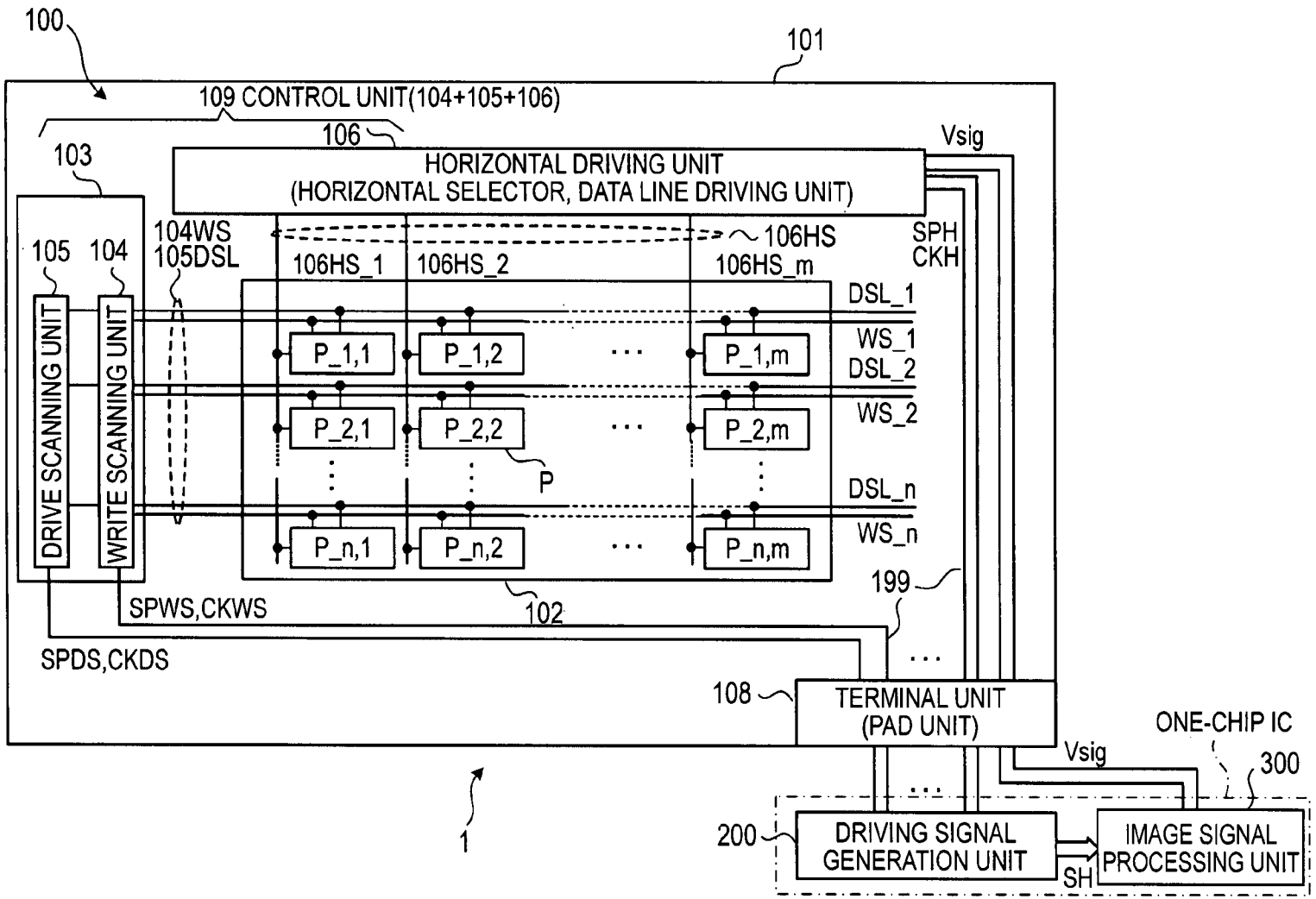
FIG. 1 is a block diagram briefly illustrating the configuration of a display apparatus according to an embodiment of the invention.

Hereinafter, embodiments of the invention will be described in detail with reference to the accompanying drawings.

The explanation will be made in the following order.

1. Basic concept (Summary of display apparatus, basis of pixel driving, grayscale control)
2. Summary of whole display apparatus
3. Pixel circuit
4. Operation (whole operation) of pixel circuit
5. Grayscale control (First comparative example, second comparative example, an embodiment (basis), and an embodiment (modified example))
6. Electronic appliance <Basic Concept>

[Summary of Display Apparatus]

First, a summary of an active matrix type display apparatus provided with electro-optical devices will be described. The display apparatus includes a plurality of pixels. Each pixel is provided with a light-emitting device (an example of an electro-optical device) having a light-emitting unit and a driving circuit of the light-emitting device.

As a light-emitting unit, for example, an organic electro luminescence (EL) light-emitting unit, an inorganic electro luminescence (EL) light-emitting unit, an LED light-emitting unit, or a semiconductor laser light-emitting unit may be used. The light-emitting unit of the organic EL device, for example, has a known configuration or structure, such as an anode electrode, a hole transport layer, a light-emitting layer, an electron transport layer, a cathode electrode, and the like. Hereinafter, as a pixel display device, an organic EL device is exemplified. However, this is exemplary, and the subject display device is not limited to the organic EL device. Generally, embodiments of the invention to be described later may be applied to the whole display device that emits light by current driving in the same manner.

The display apparatus includes at least a horizontal driving unit (signal output circuit) supplying signal potential to a pixel circuit, a write scanning unit performing scanning that supplies the signal potential supplied from the horizontal driving unit to a gate of a driving transistor, and a pixel array unit in which pixel circuits are arranged.

The pixel array unit includes light emitting devices arranged in the form of a two-dimensional matrix of H×V, H in a first direction (for example, horizontal direction) and V in a second direction that is different from the first direction (specifically, a direction that is perpendicular to the first direction, for example, vertical direction)), V write scanning lines connected to the write scanning unit and extending in the first direction, and H image signal lines (data lines) connected to the horizontal driving unit and extending in the second direction. The configuration or structure of the horizontal driving unit, the write scanning unit, and the pixel array unit may be known.

As the driving circuits for driving the light-emitting unit (light-emitting device), there are various kinds of circuits. For example, as is well known, there are a driving circuit basically configured by five transistors and one capacitance unit (5Tr/1C driving circuit), a driving circuit basically configured by four transistors and one capacitance unit (4Tr/1C driving circuit), a driving circuit basically configured by three transistors and one capacitance unit (3Tr/1C driving circuit), and a driving circuit basically configured by two transistors and one capacitance circuit (2Tr/1C driving circuit).

As transistors, as the minimum configuration, a driving transistor driving a light emitting device and a sampling transistor (write transistor) switch-driven by the write scanning unit are provided. In an embodiment of the invention, in order to realize a bootstrap function, the capacitance unit is connected between the gate and the source of the driving transistor.

The gate of the driving transistor, a source/drain area of the sampling transistor, and one connection point of one terminal of the capacitance unit may constitute a first node, and the source of the driving transistor, one terminal of the light-emitting element and a connection point of the other terminal of the capacitance unit may constitute a second node.

In the case of a color display correspondence, one pixel circuit is typically composed of three sub-pixels (a red light-emitting sub-pixel emitting red light, a green light-emitting sub-pixel emitting green light, and a blue light-emitting sub-pixel emitting blue light).

[Basis of Pixel Driving]

In the following description, it is assumed that a light-emitting device constituting each pixel is driven in line sequence, and a display frame rate is FR (times/sec). That is, V/3 pixels arranged in the v-th row (where, v=1, 2, 3, . . . , V), more specifically, the light-emitting devices constituting V sub-pixels are simultaneously driven. In other words, the timing of light emission/non-light emission of the respective light-emitting devices that constitute one row is controlled in the unit of a row to which the respective light-emitting devices belong. In this case, the process of writing an image signal with respect to the respective pixels that constitute one row may be a process of simultaneously writing an image signal with respect to all pixels (hereinafter, may simply be described as a simultaneous write process) or a process of sequentially writing image signals for each pixel (hereinafter, may simply be described as a sequential write process). The selection of the writing process may be properly performed according to the configuration of the driving circuit.

As a general rule, the driving and operation of the light-emitting element positioned in the v-th row and h-th column (h=1, 2, 3, . . . , H) will be described. Hereinafter, the light-emitting device is described as the (h,v)-th light-emitting device or the (h,v)-th sub-pixel. Also, until a horizontal scanning period of the respective light-emitting devices arranged in the v-th row (the v-th horizontal scanning period) is finished, various kinds of processes (threshold voltage cancelling process, a write process, and a mobility correction process) are performed. It is necessary to perform the write process or mobility correction process within the v-th horizontal scanning period. In this case, according to the kind of driving circuit, the threshold voltage cancelling process or a pre-processing according to this process may be performed, preceding the v-th horizontal scanning period.

After various kinds of processes are all finished, a light-emitting unit composed of the respective light-emitting devices arranged in the v-th row is operated. After various kinds of processes are all finished, the light-emitting unit may be immediately operated or may be operated after a predetermined time (for example, the horizontal scanning period as long as a predetermined number of rows) elapses. This predetermined time may be appropriately set according to the specification of the display apparatus or the configuration of the driving circuit. In the following description, for convenience in explanation, it is assumed that the light-emitting unit is immediately operated after various kinds of processes are finished. The light emission of the light-emitting unit composed of the respective light-emitting devices arranged in the v-th row continues just before the horizontal scanning period of the respective light-emitting devices arranged in the (v+v')-th row starts.

"v" is determined by the design specification of the display apparatus. That is, the light emission of the light-emitting unit composed of the respective light-emitting devices arranged in the v-th row of a certain display frame continues until the (v+v'−1)-th horizontal scanning period. On the other hand, the light-emitting unit composed of the respective light-emitting devices arranged in the v-th row maintains a non-light-emitting state as a basic rule until the write process or the mobility correction process is completed in the v-th horizontal scanning period in the next display frame from the time of the (v+v')-th horizontal scanning period. By installing the period in the non-light-emitting state (non-light-emitting period), afterimage blurring according to the driving of the active matrix is reduced, and the moving image quality becomes more superior.

However, the light-emitting state/non-light-emitting state of the respective sub-pixels (light-emitting devices) is not limited to that as described above. Also, the time length of the horizontal scanning period is a time length that is shorter than (1/FR)×(1/V) sec. If the value of (v+v') exceeds V, the exceeding horizontal scanning period is processed in the next display frame.

Regardless of the configuration of the driving circuit, the method of driving the light-emitting unit is, for example, as follows.

a) A pre-processing of applying a first node initialization voltage to the first node and applying a second node initialization voltage to the second node is performed so that an electric potential difference between the first nod and the second node exceeds the threshold voltage of the driving transistor and an electric potential difference between the second node and a cathode electrode provided in the light-emitting unit does not exceed the threshold voltage of the light-emitting unit. This process is called a pre-process. This pre-process may be divided into a discharge process and an initialization process.

b) A threshold voltage cancelling process for changing the electric potential of the second node is performed toward an electric potential obtained by subtracting the threshold voltage of the driving transistor from the electric potential of the first node in a state where the electric potential of the first node is maintained. This process is called a threshold voltage correction process.

c) A write process for applying an image signal from an image signal line to the first node through the sampling transistor that is in an on state by the signal from the write scanning line is performed. This process is called a signal write process.

d) The first node is in a floating state by making the sampling transistor in an off state by the signal from the write scanning line, and the light-emitting unit is driven by flowing current according to the electric potential value between the first node and the second node to the light-emitting unit through the driving transistor. This process is called a light-emitting process.

A mobility correction process may be added between the threshold voltage correction process and the signal write process, or the mobility correction process is performed simultaneously with the signal write process.

Here, in the threshold voltage correction process, the threshold voltage cancelling process for changing the electric potential of the second node toward the electric potential obtained by subtracting the threshold voltage of the driving transistor from the electric potential of the first node is performed. More specifically, in order to change the electric potential of the second node toward the electric potential obtained by subtracting the threshold voltage of the driving transistor from the electric potential of the first node, a voltage that exceeds a voltage obtained by adding the threshold voltage of the driving transistor to the electric potential of the second node in the pre-processing is applied to the source/drain area of one side of the driving transistors.

Qualitatively, in the threshold voltage canceling process, the degree in which the electric potential difference between the first node and the second node (in other words, the electric potential difference between the gate and source of the driving transistor) approximates to the threshold voltage of the driving transistor depends on the time for the threshold voltage cancelling process. Accordingly, for example, in a state where the time for the threshold voltage cancellation process is secured sufficiently long, the electric potential of the second node reaches the electric potential obtained by subtracting the threshold voltage of the driving transistor from the electric potential of the first node. Also, the electric potential difference between the first node and the second node reaches the threshold voltage of the driving transistor, and the driving transistor is in an off state. At this time, for example, in the the case where it is necessary to set the time for the threshold voltage cancelling process to a short time, the electric potential difference between the first node and the second node is higher than the threshold voltage of the driving transistor, and thus the driving transistor may not be in an off state. As the result of threshold voltage canceling process, it is not inevitably necessary for the driving transistor to be in an off state.

[Grayscale Control]

In the pixel driving technology according to the embodiment of the invention, the image grayscale is increased by dividing and performing the signal write several times (typically twice). For example, the first signal voltage and the second signal voltage based on the image signal are written in order with respect to the selected pixel, and at this time, by setting the first signal voltage and the second signal voltage in accordance with the grayscale of the image signal, a grayscale interpolation operation for interpolating the grayscales of the light-emitting luminance in the respective light-emitting devices is performed. Specifically, by setting the first signal voltage to any one of the plurality of interpolated grayscale voltages and setting the second signal voltage to one basic grayscale voltage that corresponds to one grayscale of the plurality of grayscales that are settable by the image signal, the grayscale interpolation operation is performed between one grayscale and a grayscale that is different from one corresponding gray scale by one step.

By applying the grayscale interpolation operation, the grayscales the number of which is larger than the number of grayscales of which the original setting is possible by the image signal, can be expressed, and thus the configuration of the driving circuit is simplified (not complicated) and high-definition grayscale expression can be performed. If it is assumed that the number of grayscales each time is K_1, K_2, and the like, the entire number of expressed grayscales becomes K_1·K_2· . . . . The low cost can be realized as the image quality is maintained, and by contrast, the high-definition can be realized as the cost is maintained.

In the display apparatus, in order to seek the cost reduction, it is an effective method to seek the cost reduction of a driver IC (Integrated Circuit) constituting the driving circuit. Since the number of expressible grayscales can be increased without changing the number of grayscale controls (for example, 10-bit grayscales/1024 grayscales) of the data driver (data line driving unit) that supplies the image signal to the respective pixels, the high-definition can be realized without causing the cost increase. By contrast, since the number of grayscale controls of the horizontal driving unit 106 can be reduced as the number of expressible grayscales is maintained, the low cost can be sought with the image quality maintained.

Also, in such writing several times, diverse methods may be considered on the point that how the signal voltage for each time is set according to the grayscale of the image signal. The number of settings becomes largest corresponds to a method of individually setting the signal voltage each times according to the grayscales of the respective image signals. Since this method can optimize the signal voltage every time according to the respective grayscales, it is a method that can perform the grayscale control with best accuracy. However, in the case of performing the writing twice (two-step driving), since the voltage written in the first step (grayscale adjustment voltage) for each grayscale (image signal voltage) in the second step is selected, it is necessary to store the voltage written in the first step that corresponds to the grayscale in the second step, and thus the memory capacity is greatly increased to cause the cost increase.

Accordingly, in an embodiment of the invention, by applying the grayscale interpolation operation by writing several times while suppressing the memory capacity, the grayscales the number of which is larger than the number of grayscales of which the original setting is possible by the image signal, can be expressed. Specifically, a standardization method is adopted through dividing of the entire number of grayscales to be expressed into a plurality of areas, and setting of the voltages for grayscale interpolation for each area of the image signal voltage. By doing this, the grayscales, the number of which is larger than the number of grayscales that the driver can originally express, can be controlled while the increase of the memory capacity is suppressed.

Typically, in the case of performing writing twice, the entire number of grayscales (that is, the image signal voltage in the second step) is divided into a plurality of areas, and the voltage setting for the grayscale interpolation that is written in the first step is commonly used for each divided area. In the case of performing writing three times, the same method is performed in the processing in the first step in the case of performing the writing twice. Since the processing time is lengthened while the number of writings is increased, it is actually optimum to apply the writing twice.

However, in the case of applying a grayscale interpolation process by writing several times in the embodiment of the invention, the voltage that is maintained in the maintenance capacitance that indicates the grayscale is greatly changed in a boundary portion (between the grayscale in the last step just before the conversion and the grayscale in the first step just after the change) where the grayscale interpolated voltage in the first step is changed. This means the destroy of gamma linearity, and for example, since it is recognized that the grayscale is changed as much as several steps even though the grayscale is originally changed only for one step, there is a possibility that the change may be felt as banding.

Accordingly, in the embodiment of the present invention, during the conversion of the grayscales, a technology of adjusting the voltage values of the first signal voltage that is used in the interpolation before/after the conversion within the range of the setting information of the first signal voltage before the conversion of the grayscale and the setting information of the first signal voltage after the conversion of the grayscale is adopted. Specifically, during the conversion, the change of the electric potential written on the gate (maintenance capacitance) of the driving transistor becomes smaller. For example, a combination of the write voltage settings in the first step before/just after the conversion may be used, or a value that is obtained by interpolating the set value of the write voltage setting in the first step before/just after the conversion may be used.

Hereinafter, a case of applying writing twice in a 2Tr/1C driving circuit having the simplest configuration will be concretely described.

<Whole Summary of Display Apparatus>

FIG. 1 is diagram briefly illustrating the entire configuration of an active matrix type organic EL display (organic EL display apparatus) using an organic EL device as a pixel display device (electro-optical device) according to an embodiment of the invention.

The organic EL display apparatus 1 includes a display panel unit 100, a driving signal generation unit 200, and an image signal processing unit 300. In the display panel unit 100, a pixel array unit 102 and a control unit 109 are installed. The driving signal generation unit 200 and the image signal processing unit 300 are an example of a panel control unit that generates diverse pulse signals for controlling driving of the display panel unit 100. The driving signal generation unit 200 and the image signal processing unit 300 are built in a one chip IC (Integrated Circuit). The illustrated product shape is exemplary, and for example, the display panel unit 100 on which the pixel array unit 102 is mounted may be provided as the organic EL display apparatus 1.

The display panel unit 100 has a terminal unit 108 (pad unit) for external connection formed thereon, and is connected to the driving signal generation unit 200 and an image signal processing unit 300. To the terminal unit 108, diverse pulse signals are supplied from the driving signal generation unit 200 arranged on the outside of an organic EL display apparatus 1. In the same manner, an image signal Vsig is supplied from the image signal processing unit 300. In the case of color display correspondence, color image signals Vsig_R, Vsig_G, and Vsig_B (in the embodiment of the invention, three primary colors of R (Red), G (Green), and B (Blue)) are supplied.

The pixel array unit 102 is configured in a manner that pixel circuits P in which pixel transistors are installed are two-dimensionally arranged in the form of a matrix with respect to organic EL devices as display devices (not illustrated), vertical scanning lines are wired by rows, and signal lines (example of horizontal scanning lines) are wired by columns with respect to the pixel arrangement. The pixel circuits P are arranged in the form of a matrix with n rows and m columns and scanning lines for driving the pixel circuits P are wired in horizontal and vertical directions so as to form an effective image area having a display aspect ratio (aspect ratio) of X:Y (for example, 9:16).

The control unit 109 has a vertical scanning unit and a horizontal scanning unit and controls a threshold value correction operation, a mobility correction operation, and a bootstrap operation. For example, the control unit 109 has a vertical driving unit 103 which is an example of a vertical scanning unit that scans the pixel circuits P in the vertical direction, and a horizontal driving unit 106 (which is also called a horizontal selector or data line driving unit) which is an example of a horizontal scanning unit that scans the pixel circuits P in the horizontal direction. The vertical driving unit 103, for example, has a write scanning unit 104 (write scanner (WS)) and a drive scanning unit 105 (drive scanner (DS)) that functions as a power scanner having a power supply capability.

On the pixel array unit 102, respective scanning lines on the vertical scanning side (vertical scanning lines: a write scanning line 104WS and a power supply line 105DSL) and an image signal line 106HS (data line) that is a scanning line on the horizontal scanning side (horizontal scanning line) are formed. On a crossing portion of the vertical and horizontal scanning lines, an organic EL device (not illustrated) and a thin film transistor (TFT) driving the organic EL device are formed.

On the respective pixel circuits P arranged in the form of a matrix, write scanning lines 104WS_1 to 104WS_n for n rows driven by a write driving pulse WS provided from the write scanning unit 104 and power supply lines 105DSL_1 to 105DSL_n for n rows driven by a power driving pulse DSL provided from the drive scanning unit 105 are wired for each pixel row. The write scanning unit 104 and the drive scanning unit 105 sequentially select the respective pixel circuits P through the write scanning line 104WS and the power supply line 105DSL based on a pulse signal of a vertical driving system that is supplied from the driving signal generation unit 200. The horizontal driving unit 106 performs sampling of a predetermined potential in the image signal Vsig through the image signal line 106HS with respect to the selected pixel circuit P and writes the sampled potential in the maintenance capacitance that is supplied from the driving signal generation unit 200 based on the pulse signal of the vertical driving system.

A configuration in which the vertical driving units 103 are arranged on both left and right sides of the pixel array unit 102 or a configuration in which the vertical driving units 106 are arranged on both upper and lower sides of the pixel array unit 102 may be adopted. Although the illustrated configuration of the vertical driving unit 103 and the scanning lines appears to match a case where the pixel circuit P has a 2TR configuration to be described later, other scanning units may be set according to the configuration of the pixel circuit P.

<Pixel Circuit>

Figure 2:
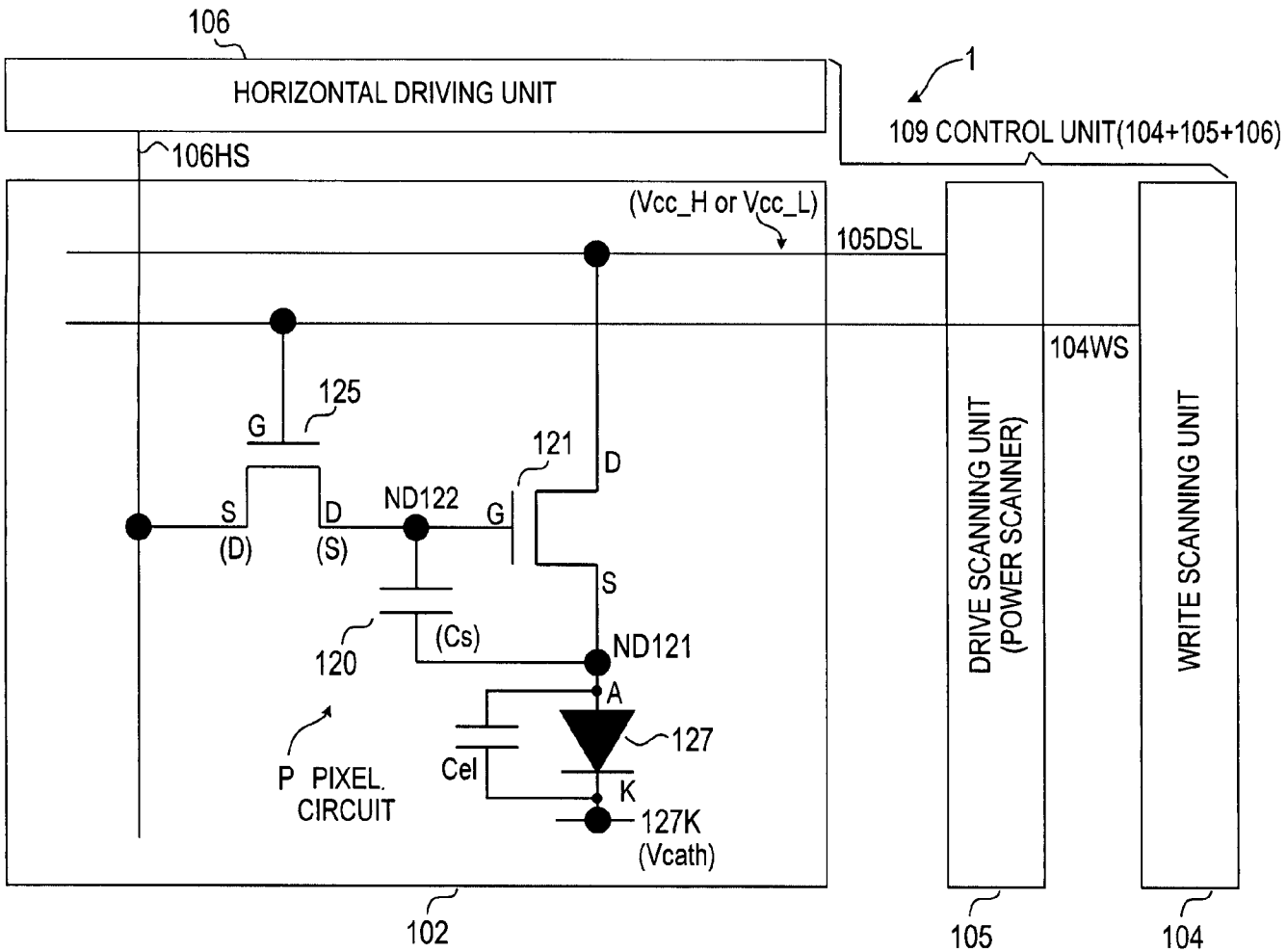
FIG. 2 is a diagram illustrating a pixel circuit according to an embodiment of the invention.

FIG. 2 is a diagram illustrating a pixel circuit P according to an embodiment of the invention. The pixel circuit P uses an n-type driving transistor 121. Further, the pixel circuit P is characterized to have a circuit for suppressing the change of the driving current Ids to the corresponding organic EL device according to a time dependent chamber of the organic EL device, that is, a driving signal regulating circuit that maintains the driving current Ids constant by correcting the change of the current-voltage characteristic of the organic EL device that is an example of the electro-optical device. Further, the pixel circuit P is also characterized to have a function of making the driving current constant even in the case where the time dependent change exists in the current-voltage characteristic of the organic EL device.

That is, the pixel circuit P adopts a 2TR drive type configuration that uses one switching transistor for scanning (sampling transistor 125) in addition to the driving transistor 121. The on/off timing (switching timing) of the power driving pulse DSL and the write driving pulse WS for controlling the respective switching transistors is set in the same manner as the operation timing to be described later. Accordingly, the influence exerted on the driving current Ids by the time dependent change of the organic EL device 127 or the characteristic change (for example, the difference or change of the threshold voltage or mobility) of the driving transistor 121 can be prevented. Since the pixel circuit P has a 2TR drive type configuration and a small number of devices and wires, high definition can be obtained.

Specifically, the pixel circuit P includes a maintenance capacitance 120, an n-type driving transistor 121, an n-type transistor 125 to which an active H (High) write driving pulse WS is supplied, and an organic EL device 127 that is an example of an electro-optical device (light-emitting device) that emits light in accordance with current flow thereto.

The maintenance capacitance 120 is connected between the gate (node ND122) and the source of the driving transistor 121, and the source of the driving transistor 121 is directly connected to the anode end portion of the organic El device 127. The cathode end portion of the organic EL device 127 is connected to a cathode common wiring 127K that is common to the entire pixels, and a cathode potential Vcath (for example, ground potential GND) is given to the cathode end portion of the organic EL device 127.

The maintenance capacitance 120 also functions as a bootstrap capacitance. That is, the pixel circuit P is a circuit which is characterized to have the maintenance capacitance 120 connected thereto and prevents the change of the driving current due to the time dependent change of the organic EL device 127, and configures a bootstrap circuit that is an example of a driving signal regulating circuit. As a method of suppressing the influence exerted on the driving current Ids by the characteristic change (for example, the difference or change of the threshold voltage or mobility) of the driving transistor 121, the driving timing of the respective transistors 121 and 125 has been studied.

The drain of the driving transistor 121 is connected to the power supply line 105 DSL from the drive scanning unit 105 that functions as a power scanner. The power supply line 105DSL has features in that it has a power supply capability with respect to the driving transistor 121. Specifically, the drive scanning unit 105 is provided with a power supply voltage conversion circuit that converts and supplies a first electric potential Vcc_H on the high voltage side and a second electric potential Vcc_L on the lower voltage side, which correspond to the power supply voltages, to the drain of the driving transistor 121.

The second electric potential Vcc_L is an electric potential that is sufficiently lower than an offset electric potential Vofs (which is also called a reference electric potential) of the image signal Vsig in the image signal line 106HS. Specifically, the second electric potential Vcc_L on the low electric potential side of the power supply line 105DSL is set so that the gate-source voltage Vgs (a difference between the gate electric potential Vg and the source electric potential Vs) of the driving transistor 121 becomes high. The offset electric potential Vofs is used to pre-charge the image signal line 106HS in addition to the initialization operation preceding the threshold value correction operation.

The sampling transistor 125 has a gate that is connected to the write scanning line 104WS from the write scanning unit 104, a drain that is connected to the image signal line 106HS, and a source that is connected to the gate (node ND122) of the driving transistor 121. The active H write driving pulse WS from the write scanning unit 104 is supplied to the gate of the sampling transistor 125. The source and the drain of the sampling transistor 125 may be reversed to each other. Also, the sampling transistor 125 may be of a depletion type or an enhancement type.

<Operation of Pixel Circuit>

Figure 3:
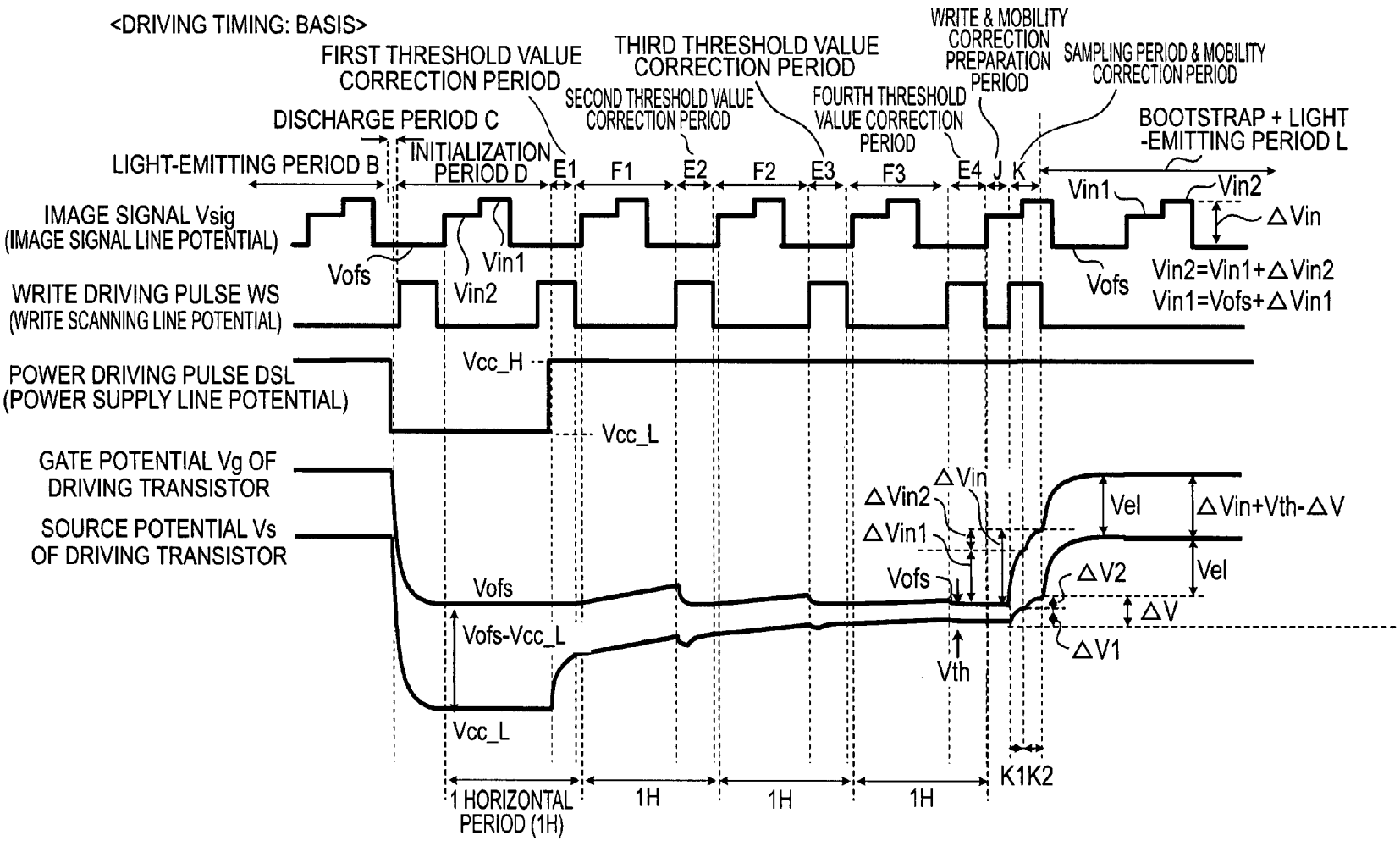
FIG. 3 is a timing chart illustrating a driving timing of a pixel circuit.

FIG. 3 is a timing chart illustrating a driving timing of a pixel circuit P illustrated in FIG. 2, which appears in the case of line sequential driving. In the timing chart, the lengths (temporal lengths) of the horizontal axis that represent respective periods are schematic, and do not represent the ratio of the temporal lengths of the respective periods.

In FIG. 3, the electric potential change of the write scanning line 104WS, the electric potential change of the power supply line 105DSL, and the electric potential change of the image signal line 106HS are represented on a common time axis. Also, in parallel with their electric potential change, the changes of the gate electric potential Vg and the source electric potential Vs of the driving transistor 121 for one row (first row in the drawing) are illustrated.

In FIG. 3, in the pixel circuit P, a basic example for realizing the threshold value correction function, the mobility correction function, and the bootstrap function is illustrated. The driving timings for realizing the threshold value correction function, the mobility correction function, and the bootstrap function are not limited to those as illustrated in FIG. 3, and diverse modifications may be made. Even in the variously modified driving timings, the configurations of respective embodiments to be described later can be applied.

The driving timings illustrated in FIG. 3 correspond to the case of line sequential driving, and the timings (particularly, phase relations) of the write driving pulse WS, the power driving pulse DSL, and the image signal Vsig, which for one row are considered as one set, are independently controlled in the unit of a row, and if the row is changed, the signals are shifted for 1H (Horizontal scanning period).

Hereinafter, for easy explanation or understanding, unless specially mentioned, it is assumed that the write gain is 1 (ideal value), and writing, maintaining, and sampling of information on a signal amplitude ΔVin in the maintenance capacitance 120 will be briefly described. The ratio of the size of information written in the maintenance capacitance 120 that corresponds to the signal amplitude ΔVin is called a write gain. If the write gain is less than 1, a gain-multiplied information that corresponds to the size of the signal amplitude ΔVin is maintained in the maintenance capacitance 120 rather than the size of the signal amplitude ΔVin itself. In the same manner, explanation will be briefly made under the assumption that the bootstrap gain is 1 (ideal value). In the case where the maintenance capacitance 120 is installed between the gate and source of the driving transistor 121, the increasing rate of the gate electric potential Vg to the increase of the source electric potential Vs is called a bootstrap gain.

In the driving timing as described herein, it is assumed that a period in which the image signal Vsig is at the offset electric potential Vofs that is an ineffective period is a first half of one horizontal period, and a period in which the image signal Vsig is at the signal electric potential Vin (=Vofs+ΔVin) is a latter half of one horizontal period. In the period in which the image signal Vsig is at a signal electric potential Vin (=Vofs+ΔVin) that is the effective period of the image signal Vsig, two-step electric potentials Vin1 and Vin2 are set to apply the grayscale interpolation operation (the details thereof will be described later). The signal electric potential Vin1 at the first step is a value that is obtained by adding the signal amplitude ΔVin1 at the first step to the offset electric potential Vofs, and the signal electric potential Vin2 at the second step is a value that is obtained by adding the signal amplitude ΔVin2 at the second step to the signal electric potential Vin1 at the first step. For one horizontal period that corresponds to the sum of the effective period and the ineffective period of the image signal Vsig, the threshold value correction operation is repeated plural times (in the drawing, four times).

In the light-emitting period B (display period) of the organic EL device 127, the power supply line 105DSL is at the first electric potential Vcc_H, and the sampling transistor 125 is in an off state. In this case, since the driving transistor 121 is set to operate in a saturation region, the driving current Ids that flows through the organic EL device 127 takes a value that is represented by Equation (1) according to the gate-source voltage of the driving transistor 121.

The driving transistor 121 is driven in a saturation region in which the driving current Ids becomes constant regardless of the drain-source voltage. If it is assumed that the current flowing between the drain and the source of the transistor that operates in the saturation region is Ids, the mobility is μ, the channel width (gate width) is W, the channel length (gate length) is L, the gate capacitance (capacitance of a gate oxide film per unit area) is Cox, and the threshold voltage of the transistor is Vth, the driving transistor 121 becomes a constant current source having a value indicated in Equation (1) ("^" denotes a square). As can be known from Equation (1), in the saturation region, the drain current Ids of the transistor is controlled by the gate-source voltage Vgs, and the transistor operates as a constant current source.

$$Ids = \frac{1}{2}\mu\frac{W}{L}\mathrm{Cox}(Vgs - Vth)\text{^}2 \tag{1}$$

If a non-light-emitting period (quenching period) arrives, first, in a discharge period C, the power supply line 105DSL is converted into the second electric potential Vcc_L. In this case, if the second electric potential Vcc_L is lower than the sum of the threshold voltage VthEL of the organic EL device 127 and the cathode electric potential Vcath, that is, if the condition satisfies "Vcc_L<VthEL+Vcath", the organic EL device 127 is in a quenching state, and the power supply line 105DSL becomes the source side of the driving transistor 121. At this time, the anode of the organic EL device 127 is charged with the second electric potential Vcc_L. That is, by making the electric potential of the drain of the driving transistor 121 (power supply terminal) equal to the electric potential of the source of the driving transistor 121 (output terminal), the organic EL device 127 is shifted from the light-emitting state to the quenching state.

Further, in the initialization period D, when the image signal line 106HS is at the offset electric potential Vofs, the sampling transistor 125 is turned on and the gate electric potential of the driving transistor 121 becomes the offset electric potential Vofs. In this case, the gate-source voltage Vgs of the driving transistor 121 takes a value of "Vofs−Vcc_L". If "Vofs−Vcc_L" is not higher than the threshold voltage Vth of the driving transistor 121, the threshold value correction operation may not be performed, and thus it is necessary to make "Vofs−Vcc_L>Vth".

Thereafter, if the first threshold value correction period E1 arrives, the power supply line 105DSL is converted into the first electric potential Vcc_H again. While the power supply line 105DSL (that is, the power supply voltage to the driving transistor 121) becomes the first electric potential Vcc_H, the anode of the organic EL device 127 becomes the source of the driving transistor 121, and the driving current Ids flows from the driving transistor 121. Since the equivalent circuit of the organic EL device 127 is represented by a diode and capacitance, the condition satisfies "Vel≦Vcath+VthEL" on the assumption that the anode electric potential against the cathode electric potential Vcath of the organic EL device 127 is Vel. In other words, so far as the leak current of the organic EL device 127 is considerably smaller than the current flowing through the driving transistor 121, the driving current Ids of the driving transistor 121 is used to charge the maintenance capacitance 120 and a parasitic capacitance Cel of the organic EL device 127. In this case, the anode electric potential Vel of the organic EL device 127 is increased with the lapse of time.

After a predetermined time elapses, the sampling transistor 125 is turned off. At this time, if the gate-source voltage Vgs of the driving transistor 121 is higher than the threshold voltage Vth (that is, if the threshold value correction is not completed), the driving current Ids of the driving transistor 121 continuously flows so that the maintenance capacitance 120 receives power, and thus the gate-source voltage Vgs of the driving transistor 121 is increased. At this time, since the organic EL device 127 is reversely biased, the organic EL device 127 does not emit light.

If the second threshold value correction period E2 arrives, the sampling transistor 125 is turned on when the image signal line 106HS reaches the offset electric potential Vofs, and the gate electric potential of the driving transistor 121 becomes the offset electric potential Vofs to start the threshold value correction operation again. By repeating this operation, finally, the gate-source voltage Vgs of the driving transistor 121 takes the value that corresponds to the threshold voltage Vth. At this time, the condition satisfies "Vel=Vofs−VthVcath+VthEL."

In this operational example, the threshold value correction operation is repeated several times in consideration of one horizontal period as a processing cycle in order to maintain the voltage that corresponds to the threshold voltage Vth of the driving transistor 121 in the maintenance capacitance 120. However, such repeated operation is not compulsory, and the threshold value correction operation may be performed only once in consideration of one horizontal period as the processing cycle.

After the threshold value correction operation is finished (in this embodiment, after the fourth threshold value correction period E4), the sampling transistor 125 is turned off and a write and mobility correction preparation period J begins. When the image signal line 106HS is at the signal electric potential Vin (=Vofs+ΔVin), the sampling transistor 125 is turned on again, and the sampling period and the mobility correction period K begin. In this embodiment of the invention, by installing the sampling period and the mobility correction period K several times (in the drawing, twice), the entire number of grayscales is extended in comparison to the number of grayscales that are expressible in the signal writing only once. The first step is specifically called the grayscale interpolation period and the mobility correction period K1, and the second step is specifically called the grayscale confirmation period and the mobility correction period K2. Here, the sampling period and the mobility correction period K will be described through addition of both periods, and the details of applying the grayscale interpolation operation will be described later.

The signal amplitude ΔVin is a value according to the grayscale. Since the sampling transistor 125 is in an on state, the gate electric potential of the sampling transistor 125 becomes the signal electric potential Vin (=Vofs+ΔVin=ΔVin1+ΔVin2). However, since the drain of the driving transistor 121 is at the first electric potential Vcc_H and the driving current Ids flows, the source electric potential Vs is increased with the lapse of time. In the drawing, this increment is represented as ΔV (=ΔV1+ΔV2).

If the source voltage Vs does not exceed the sum of the threshold voltage VthEL of the organic EL device 127 and the cathode electrode Vcath, in other words, if the leak current of the organic EL device 127 is considerably smaller than the current flowing through the driving transistor 121, the driving current Ids of the driving transistor 121 is used to charge the maintenance capacitance 120 and the parasitic capacitance Cel of the organic EL device 127.

At this time point, since the threshold value correction operation of the driving transistor 121 is completed, the current that flows through the driving transistor 121 reflects the mobility μ. Specifically, if the mobility μ is high, the amount of current at this time becomes large, and the increase of the source becomes fast. By contrast, if the mobility μ is low, the amount of current at this time becomes small, and the increase of the source becomes slow. Accordingly, the gate-source voltage Vgs of the driving transistor 121 becomes low through reflection of the mobility μ, and after a predetermined time, the gate-source voltage Vgs corrects the mobility μ completely.

Thereafter, the light-emitting period L begins, the sampling transistor 125 is turned off to finish the writing, and the organic EL device 127 emits light. Since the gate-source voltage Vgs of the driving transistor 121 is constant by the bootstrap effect through the maintenance capacitance 120, the driving transistor 121 makes a predetermined current (driving current Ids) flow to the organic EL device 127, and the anode electric potential Vel of the organic EL device 127 is increased up to the voltage Vx at which the current that is the driving current Ids flows through the organic EL device 127 to make the organic EL device 127 emit light.

In the pixel circuit P, if the light-emitting time is long, the I-V characteristic of the organic EL device 127 is changed. Because of this, the electric potential of the node ND121 (that is, the source electronic potential Vs of the driving transistor 121) is also changed. However, since the gate-source voltage Vgs of the driving transistor 121 is maintained constant by the bootstrap effect by the maintenance capacitance 120, the current flowing through the organic EL device 127 is not changed. Accordingly, even if the I-V characteristic of the organic EL device 127 deteriorates, a constant current (driving current Ids) continuously flows through the organic El device 127, and thus the luminance of the organic EL element 127 is not changed.

Here, the relationship between the driving current Ids and the gate voltage Vgs may be expressed by Equation (2) by substituting "ΔVin+Vth−ΔV" in Vgs of Equation (1) that represents the transistor characteristic. In Equation (2), k is k=(½)(W/L)Cox.

$$Ids=k\mu(Vgs-Vth)^2=k\mu(\Delta Vin-\Delta V)^2 \quad (2)$$

From Equation (2), the term of the threshold voltage Vth is cancelled, and thus it is known that the driving current Ids that is supplied to the organic EL device 127 does not depend on the threshold voltage Vth of the driving transistor 121. Basically, the driving current Ids is determined by the signal amplitude ΔVin (in detail, the sample voltage (=Vgs) that is maintained in the maintenance capacitance 120 to correspond to the signal amplitude ΔVin). In other words, the organic EL device 127 emits light with the luminance according to the signal amplitude ΔVin.

At this time, the information that is maintained in the maintenance capacitance 120 is corrected to the increment ΔV of the source electric potential Vs. The increment ΔV acts to accurately remove the effect of the mobility μ that is positioned in a coefficient unit of Equation (2). Although the correction amount ΔV for the mobility μ of the driving transistor 121 is added to the signal written in the maintenance capacitance 120, the direction of the increment ΔV is actually the negative direction, and in this sense, the increment ΔV is also called a mobility correction parameter ΔV or a negative feedback amount ΔV.

The change of the threshold voltage Vth of the driving transistor 121 or the mobility μ is offset, and the driving current Ids, which flows through the organic El device 127, actually depends on the signal amplitude ΔVin. Since the driving current Ids does not depend on the threshold voltage Vth or the mobility μ, the driving current Ids between the drain and the source is not changed and thus the light-emitting luminance of the organic EL device 127 is not changed even though the threshold voltage Vth or the mobility μ is changed by a manufacturing process or the time dependent change occurs.

By connecting the maintenance capacitance 120 between the gate and the source of the driving transistor 121, even in the case of using an n-type driving transistor 121, the bootstrap function for making the gate electric potential Vg interlock with the change of the source electric potential Vs of the driving transistor 121 is realized by the circuit configuration and the driving timing. Accordingly, even though the anode electric potential of the organic El device 127 is changed (that is, the source electric potential of the driving transistor 121 is changed) due to the time dependent change of the characteristics of the organic EL device 127, the gate electric potential Vg may be changed to offset the change.

Accordingly, the influence on the time dependent change of the characteristics of the organic EL device 127 is mitigated, and the uniformity of the screen luminance is secured. By the bootstrap function by the maintenance capacitance 120 between the gate and source of the driving transistor 121, the time dependent change correction capability of the current drive type light-emitting device, which represents the organic EL device, can be improved. Of course, the bootstrap function operates even when the source electric potential Vs of the driving transistor 121 is changed in accordance with the change of the anode-cathode voltage Vel in the process in which the light-emitting current Iel starts to flow through the organic EL device 127 at the light emission start point, and thereby the anode-cathode voltage Vel is increased until the voltage Vel becomes stable.

As described above, according to the driving timing by the pixel circuit P and the control unit 109 that drives the pixel circuit P, even though the characteristics of the driving transistor 121 or the organic EL device 127 are changed (a difference or time dependent change), the influence does not appear on the display screen by correcting their change amount, and thus high-definition image display without luminance change can be made.

<Grayscale Control>

Hereinafter, the grayscale control that applies the grayscale interpolation operation (operation of interpolating the grayscales of the light-emitting luminance in the respective organic EL devices 127), which is one of the characterizing portion during the display operation in the organic EL display device 1 according to the embodiment of the invention will be described in comparison to the grayscale control in the comparative example.

FIRST COMPARATIVE EXAMPLE

Figure 4A:
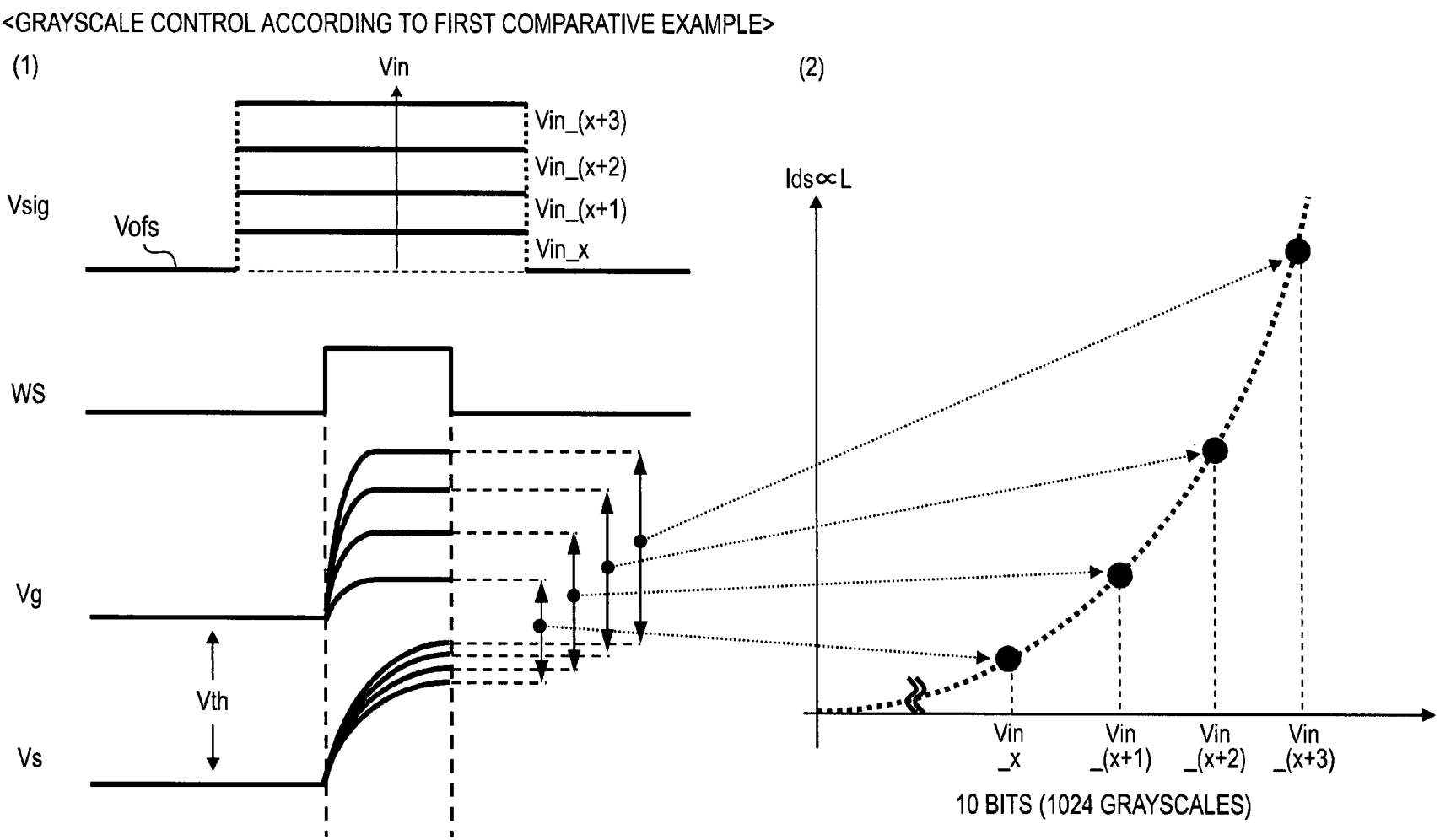
FIG. 4A is a diagram illustrating grayscale control according to a first comparative example.

FIG. 4A is a diagram illustrating the grayscale control (operation in the sampling period and the mobility correction period K) according to the first comparative example. In the first comparative example, the signal writing and the mobility correction are performed only once in the sampling period and the mobility correction period K. Specifically, as illustrated in (1) of FIG. 4A, the write operation of the signal voltage Vin (signal amplitude ΔVin) that corresponds to the image signal Vsig and the mobility correction (which increases the source electric potential Vs as much as the potential difference ΔV) are performed only once. That is, the mobility correction is performed even with the signal electric potential Vin of the image signal Vsig only once to express a desired grayscale (of 8 bits or 10 bits).

In the display operation according to the first comparative example, the relationship (a gamma curve) between the signal voltage Vin and the current Ids (that is in proportion to the light-emitting luminance L of the organic EL device 127) that flows through the driving transistor 121 is, for example, as illustrated in (2) of FIG. 4A. That is, as the grayscales of the signal voltage Vin that is set in the image signal Vsig is increased, for example, as voltages x, x+1, x+2, and the like, the grayscales of the current Ids (light-emitting luminance L) is increased in a one-to-one relationship. Specifically, when the signal voltage Vin is set to the voltage x, the current Ids is set to the current value Ids(x) and the light-emitting luminance L is set to the luminance L(x). When the signal voltage Vin is set to the voltage (x+1), the current Ids is set to the current value Ids (x+1) and the light-emitting luminance L is set to the luminance L (x+1). When the signal voltage Vin is set to the voltage (x+2), the current Ids is set to the current value Ids (x+2) and the light-emitting luminance L is set to the luminance L (x+2).

Accordingly, in the case of the first comparative example, the number of grayscales of the light-emitting luminance L is constantly determined by the number of grayscales (the number of bits of the image signal Vsig) that can be set by the image signal Vsig, in other words, the number of voltage values that can be set in the signal voltage Vin. Specifically, for example, in the case where the image signal Vsig displays the signal voltage Vin with 8 bits, the number of grayscales of the expressible light-emitting luminance L becomes 2^8=256. Also, in the case where the image signal Vsig displays the signal voltage Vin with 10 bits, the number of grayscales of the expressible light-emitting luminance L becomes 2^10=1024.

Accordingly, as one technique for realizing the low cost of the whole display apparatus, for example, in the case of seeking the cost reduction of a data driver (corresponds to the horizontal driving unit 106), the display apparatus that uses the display operation in the first comparative example has the following problems. That is, for example, although it is considered to seek the cost reduction of the data driver by reducing the number of grayscales (the number of bits of the signal voltage Vin) that are settable by the image signal Vsig, in the case of the first comparative example, the number of grayscales of the expressible light-emitting luminance L is also reduced accordingly. Specifically, in order to realize the low cost with respect to the 10-bit grayscales (1024 grayscales) that are general at the present time, for example, it is necessary to thin out the number of grayscales such as 8-bit grayscales (256 grayscales) or the like. If the number of grayscales of the expressible light-emitting luminance L is reduced, the display image quality also deteriorates accordingly. By contrast, if it is intended to realize 12-bit grayscales (4096 grayscales), the cost is increased. In the case of the first comparative example, it is difficult to realize high definition while seeking cost reduction (both cost reduction and high definition).

SECOND COMPARATIVE EXAMPLE

Figure 4B:
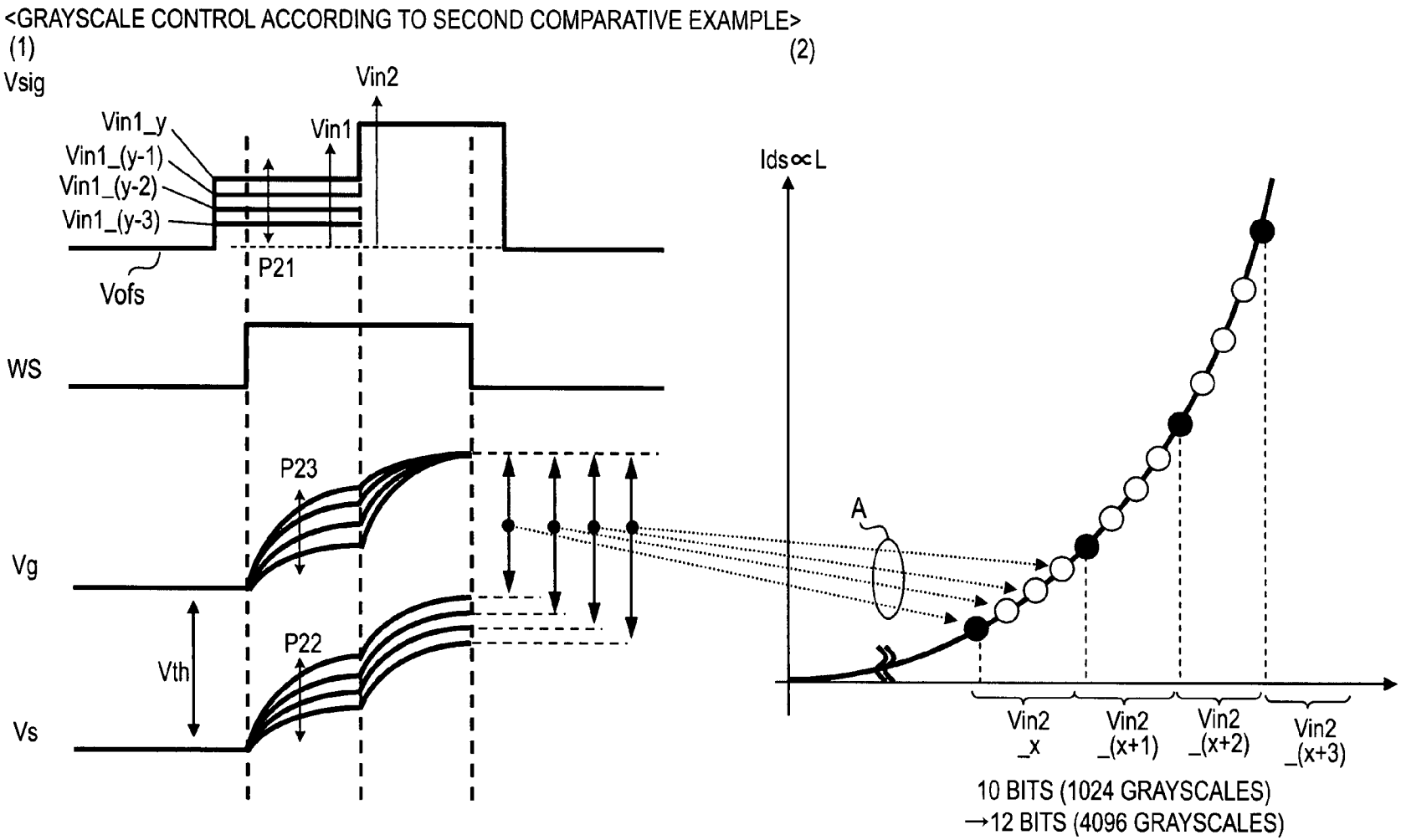
FIG. 4B is a diagram illustrating grayscale control according to a second comparative example.

FIG. 4B is a diagram illustrating the grayscale control (operation in the sampling period and the mobility correction period K) according to the second comparative example. The second comparative example is similar to the operation of the embodiment of the invention on the point that the signal writing and the mobility correction are performed twice in the sampling period and the mobility correction period K. The difference between them is that the first signal voltage and the second voltage value are change according to the grayscales of the image signal. For example, as illustrated in (1) of FIG. 4B, the grayscale interpolation period and the mobility correction period K1 and the grayscale confirmation period and the mobility correction period K2 are installed.

In the grayscale interpolation period and the mobility correction period K1, the horizontal driving unit 106 supplies the grayscale interpolation voltage Vin1 that is the signal voltage Vin for the grayscale interpolation operation to the image signal line 106HS, and in the grayscale interpolation period and the mobility correction period K2, the horizontal driving unit 106 supplies the confirmation grayscale voltage Vin2 that is the signal voltage Vin for confirming the grayscales to the image signal line 106HS. Particularly, the horizontal driving unit 106 in the second comparative example simultaneously supplies two signal voltages to the image signal line 106HS, as illustrated in (1) of FIG. 4B, in the order of the grayscale interpolation voltage Vin1 and the confirmation grayscale voltage Vin2, and individually changes the voltage values of the grayscale interpolation voltage Vin1 and the confirmation grayscale voltage Vin2 according to the grayscales. At this time, the write scanning unit 104 makes the sampling transistor 125 continue a turned-on state by maintaining the write driving pulse WS at H level even in the case where the write scanning unit 104 is shifted from the grayscale interpolation voltage Vin1 to the confirmation grayscale voltage Vin2.

Although not illustrated, the sampling period and the mobility correction period K are installed through a 2H period, and the bootstrap period is inserted between the grayscale interpolation period and the mobility correction period K1 and the grayscale confirmation period and the mobility correction period K2 by making the write driving pulse WS in L level and turning off the sampling transistor 125. This point is the same as the operation according to the embodiment of the invention.

By the operation according to the second comparative example, as the portion indicated by an arrow A in (2) of FIG. 4B, the grayscale interpolation operation for interpolating the grayscales of the light-emitting luminance L in the respective organic EL devices 127 is performed. As a result, the expression of the grayscales, the number of which is larger than the number of grayscales of which the original setting is possible by the image signal Vsig, is realized. For example, in the case where the voltage x or the like that is set in the signal voltage Vin in the operation of the first comparative example as illustrated in (1) of FIG. 4A is a 10-bit grayscales, grayscales (four grayscales) for two bits are interpolated with respect to the 10-bit grayscales, as illustrated in (2) of FIG. 4B, and thus 12-bit grayscales are realized. That is, grayscales (four grayscales) for two bits are interpolated using the voltage y (interpolation grayscale voltage) that is set in the grayscale interpolation voltage Vin1 with respect to the voltage x (basic grayscale voltage) set in the confirmation grayscale voltage Vin2, and 12-bit grayscales in total are realized. With respect to the gamma characteristic of the 10-bit image signal Vsig (the confirmation grayscale voltage Vin2), the 12-bit grayscales can be realized by interpolating the grayscales for "12 bits−10 bits=2 bits" by write driving twice (2 step driving).

Specifically, the horizontal driving unit 106, for example, as illustrated in (1-1) to (1-4) of FIG. 4B, fixedly sets the confirmation grayscale voltage Vin2 to a voltage (here, the voltage x) which corresponds to one grayscale among the plural grayscales (here, 10-bit grayscales=1024 grayscales) that can be set by the image signal Vsig. Then, for example, as indicated by an arrow P21 in (1-1) of FIG. 4B, the horizontal driving unit 106 changes the grayscale interpolation voltage Vin1 among the plural voltages (here, four voltages of (y-3), (y-2), (y-1), and y). Also, the horizontal driving unit 106 repeats to fixedly set the confirmation grayscale voltage Vin2 to another grayscale among the plural grayscales and to change the grayscale interpolation voltage Vin1 among the plural voltages.

In this case, as indicated by arrows P21 and P22 in (1-1) and (1-4) of FIG. 4B, the source electric potential Vs of the driving transistor 121 after the grayscale interpolation voltage Vin1 is written is greatly increased as the voltage value of the grayscale interpolation voltage Vin1 is increased from the voltage (y-3) to the voltage y. For example, the increment (potential difference $\Delta V1(y)$) of the source electric potential Vs when the grayscale interpolation voltage Vin1 is set to the voltage y becomes greater than the increment (potential difference $\Delta V1(y\text{-}3)$ by the mobility correction only once) of the source electric potential Vs when the grayscale interpolation voltage Vin1 is set to the voltage (y-3). At this time, in the grayscale interpolation period and the mobility correction period K1, as indicated by an arrow P23 in (1-3) of FIG. 4B, the source electric potential Vs of the driving transistor 121 is increased, and thus the gate electric potential Vg of the driving transistor 121 is also increased accordingly. That is, as the voltage value of the grayscale interpolation voltage Vin1 is increased from the voltage (y-3) to the voltage y, the gate electric potential Vg after the grayscale interpolation voltage Vin1 is written is greatly increased.

In the grayscale interpolation period and the mobility correction period K2, the increment (the potential difference $\Delta V2$ by the mobility correction twice) of the source electric potential Vs of the driving transistor 121 is constant regardless of the voltage value of the grayscale interpolation voltage Vin1, as illustrated in (1-4) of FIG. 4B. This is because the increment (potential difference ΔV2) of the source electric potential Vs in the grayscale confirmation period and the mobility correction period K2 is determined by the voltage value (here, Vin2_x) of the confirmation grayscale voltage Vin2 that is written at this time. After this period is finished, the gate electric potential Vg of the driving transistor 121 becomes the confirmation grayscale voltage Vin2 (here, voltage x) ((1-3) of FIG. 4B). From this, as can be seen from (1) of FIG. 4B, as the voltage value of the grayscale interpolation voltage Vin1 is increased from the voltage (y-3) to the voltage y, the gate-source voltage Vgs of the driving transistor 121 after the confirmation grayscale voltage Vin2 is written (during the light-emitting operation) becomes low. For example, the gate-source voltage Vgs(y) when the grayscale interpolation voltage Vin1 is set to the voltage y is lower than the gate-source voltage Vgs(y-3) when the grayscale interpolation voltage Vin1 is set to the voltage (y-3).

Accordingly, as the voltage value of the grayscale interpolation voltage Vin1 is increased, the gate-source voltage Vgs of the driving transistor 121 during the light-emitting operation becomes low. Accordingly, the current Ids that flows through the driving transistor 121 is reduced, and in proportion to the reduction of the current Ids, the light-emitting luminance L of the organic EL device 127 is also lowered.

Using this, the horizontal driving unit 106, for example, as illustrated in (2) of FIG. 4B, selects and allocates the voltage y or the like that corresponds to four grayscales set by the grayscale interpolation voltage with respect to the voltage x or the like that corresponds to the grayscale that can be set by the confirmation grayscale voltage Vin2. Accordingly, the grayscale interpolation operation is realized, and thus the expression of grayscales the number of which is larger than the number of grayscales of which the original setting is possible can be realized by the image signal Vsig.

In the case of the second comparative example, since the voltage values of the grayscale interpolation voltage Vin1 and the confirmation grayscale voltage Vin2 are individually changed according to the grayscales, the signal voltages for respective times can be optimized according to the respective grayscales. However, the setting of the grayscale interpolation voltage Vin1 (a set of Vin_y, Vin_(y-1), Vin_(y-2), and Vin_(y-3)) that is written at the first step for each confirmation grayscale voltage Vin2 at the second step is prepared, and the setting of the grayscale interpolation voltage Vin1 that is appropriate to the subject confirmation grayscale voltage Vin2 at the second step is selected. Because of this, it is necessary to store the setting information of the grayscale interpolation voltage Vin1 that is written at the first step that corresponds to the confirmation grayscale voltage Vin2 at the second step, and this causes the increase of the cost. In order to realize low cost and high image quality (both cost reduction and high image quality), the memory amount may be improved.

Embodiment

Basis

Figure 5A:
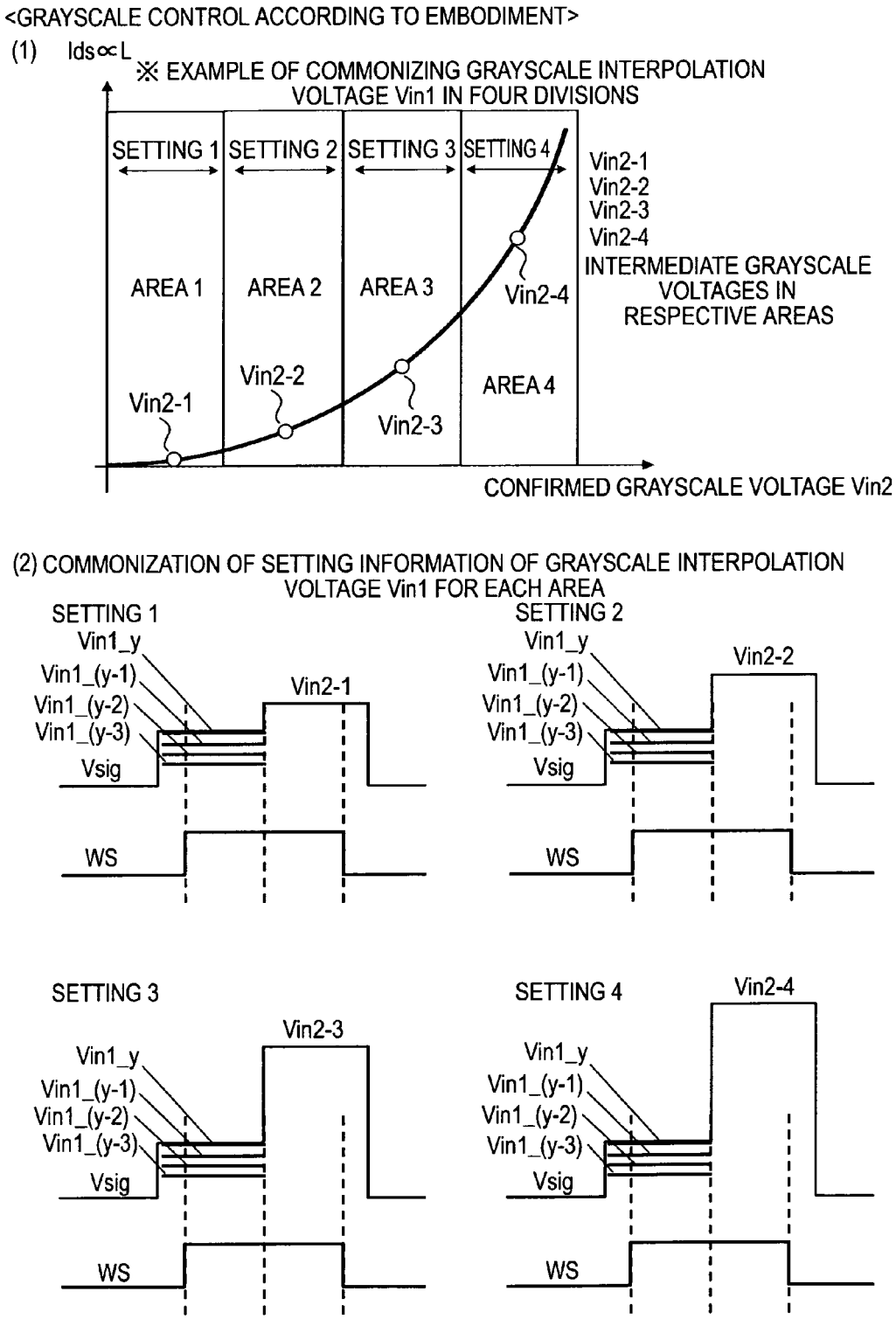
FIG. 5A is a diagram illustrating the basis of grayscale control according to an embodiment of the invention.

FIG. 5A is a diagram illustrating the grayscale control (operation in the sampling period and the mobility correction period K) according the embodiment of the invention. This embodiment of the invention is similar to the operation of the second comparative example on the point that the signal writing and the mobility correction are performed twice in the sampling period and the mobility correction period K. The difference between them is that the grayscale range is divided into areas, and the grayscale interpolation voltage Vin1 is commonized by setting the grayscale interpolation voltage Vin1 for each area of the confirmation grayscale voltage Vin2 (that is, display grayscale voltage). In the respective divided areas, the setting of the grayscale interpolation voltage Vin1 (for example, a set of Vin_y, Vin_(y-1), Vin_(y-2), and Vin_(y-3)) which is written at the first step that is common in the respective divided areas is prepared, and the grayscale is determined by the confirmation grayscale voltage Vin2 at the second step. By commonizing the voltage (grayscale interpolation voltage Vin1) that is written at the first step between certain grayscales, the memory amount can be greatly reduced. Accordingly, it is not necessary to increase the memory, and thus multi grayscale can be realized inexpensively.

For example, in FIG. 5A, the entire grayscales are divided into four areas, the voltage setting (grayscale interpolation voltage Vin1) at the first step that is common in the respective divided areas is made, and the grayscale is determined by the voltage (confirmation grayscale voltage Vin2) at the second step. The size of division is not limited to the equal size, and may be optional. For example, it is considered that the low grayscale side is widely taken and the high grayscale side is narrowly taken. Accordingly, it is sufficient if the grayscale interpolation voltage Vin1 is set only within the respective divided areas, and thus the memory can be greatly reduced.

However, if the voltage setting that is written at the first step is converted between certain grayscales in the case of applying the grayscale interpolation process by plural times writing according to this embodiment, the linearity of gamma (γ) is destroyed in a conversion place, and there is a possibility that the change may be visually recognized as banding.

In the case of applying the driving technique according to the embodiment of the invention as a countermeasure, it is preferable to commonly use the technique that prevents the gamma characteristic from being destroyed before and after the conversion of the setting of the grayscale interpolation voltage Vin1 (for example, a set of Vin_y, Vin_(y-1), Vin_(y-2), and Vin_(y-3)). Hereinafter modified examples that adopt the technique will be described.

Embodiment

Modified Examples

Figure 5B:
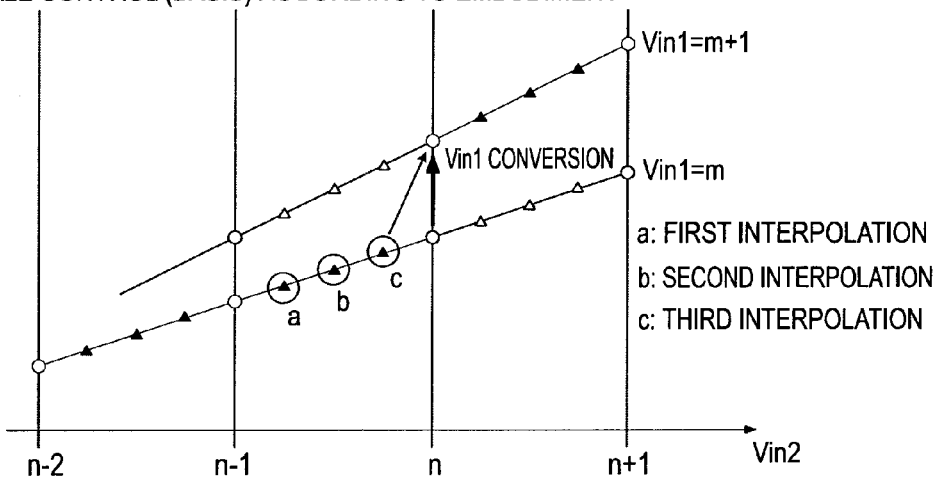
FIG. 5B is a diagram illustrating a modified example of grayscale control according to an embodiment of the invention.
Figure 5B:
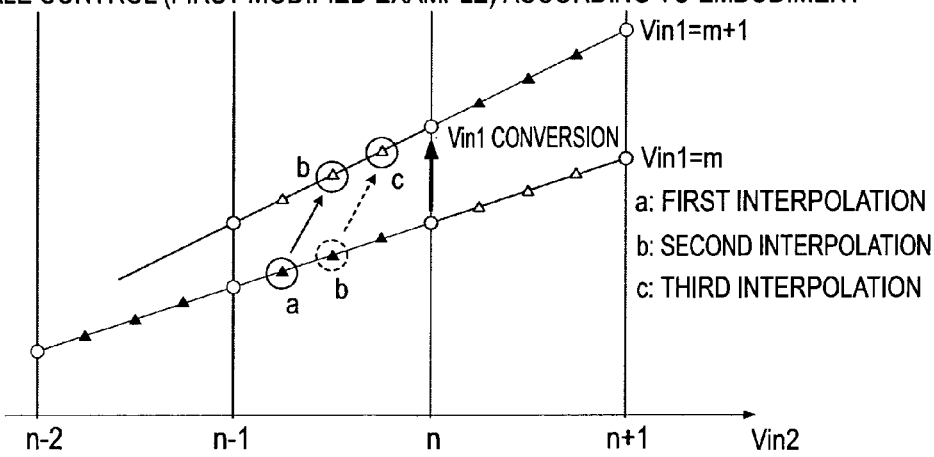
Figure 5B:
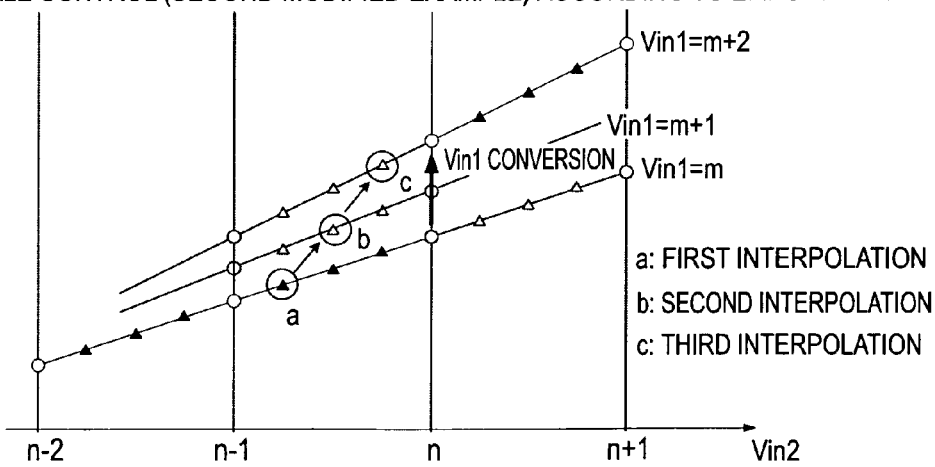

FIG. 5B is a diagram illustrating the operation of the modified examples in the sampling period and the mobility correction period according to the embodiment of the invention. The drawing represents a case of expressing a driver output+2 bits. (1) of FIG. 5B shows the basic operation, (2) of FIG. 5B shows the operation according to a first modified example, and (3) of FIG. 5B shows the operation according to a second modified example.

As illustrated in (1) of FIG. 5B, in the case of converting the voltage setting V1 that is written at the first step between certain grayscales (for example, between Vin2=n−1 and Vin2=n) according to the basic operation, for example, the voltage setting V1 (=m) and the voltage setting V1 (=m+1) are selectively used as the grayscale interpolation voltage Vin1, and the change state of the grayscale voltage that is maintained from the conversion place to the maintenance capacitance 120 becomes different.

In the first modified example, in the case of the voltage setting V1 of the grayscale interpolation voltage Vin1 that is written at the first step between certain grayscales, in the grayscale just before the conversion, the gamma linearity is maintained by combining the voltage settings V1 at the first step before and after the conversion. For example, in the transition process as indicated by a solid line in (2) of FIG. 5B, the setting before the conversion (voltage setting of V1=m) is used at the first point a of the signal that is interpolated between certain grayscales (for example, between Vin2=n−1 and Vin2=n), but the setting just after the conversion (voltage setting of V1=m+1) is used at the second point b and the third point c. In the transition process as indicated by a dashed line in (2) of FIG. 5B, the setting before the conversion (voltage setting of V1=m) is used at the first point a and the second point b, and the setting just after the conversion (voltage setting of V1=m+1) is used at the third point c. However, the grayscale voltage difference during the conversion becomes smaller in the transition process as indicated by the solid line in comparison to the transition process as indicated by the dashed line.

Also, in the second modified example, in the case of converting the setting (voltage setting V1) of the grayscale interpolation voltage Vin1 that is written at the first step between certain grayscales, in the grayscale just before the conversion, the gamma linearity is maintained by using the voltage value that is obtained by interpolating the voltage setting V1 at the first step just after the conversion. For example, as illustrated in (2) of FIG. 5B, the interpolation is performed in a manner that the first point a of the signal that is interpolated between certain grayscales (for example, between Vin2=n−1 and Vin2=n) is interpolated using the setting value before the conversion (based on the voltage setting of V1=m), the second point b is interpolated using the intermediate value (based on the voltage setting of V1=m+1), and the third point c is interpolated using the setting value just after the conversion (based on the voltage setting of V1=m+2), and thus the gamma linearity is maintained. In this example, a memory is prepared for setting the intermediate value. However, this is not compulsory, and the intermediate value may be obtained through calculation using the setting value before the conversion (based on the voltage setting of V1=m) and the setting value just after the conversion (based on the voltage setting of V1=m+1) to reduce the memory capacity.

[Summary of Grayscale Control in an Embodiment]

As described above, in a driving method for the grayscale control according to this embodiment, in the grayscale interpolation driving using writing twice, the grayscale interpolation voltage Vin1 is set and commonized for each area of the confirmation grayscale voltage Vin2, the grayscales, the number of which is larger than the number of grayscales of which the original setting is possible at the existing driver output, can be expressed without greatly increasing the memory capacity. Accordingly, the configuration of the horizontal driving unit 106 is simplified (not complicated), and the grayscale expression with higher definition can be realized. For example, even in the case of using the data driver (the horizontal driving unit 106) that can output M-bit (where, M is an integer) image signal Vsig, N-bit (where, N is an integer, N>M) grayscale expression can be performed, and thus the cost reduction of the control unit 109 can be sought. Accordingly, high image quality can be realized while seeking cost reduction (both cost reduction and high image quality can be realized).

Also, to cope with the destroy of the gamma linearity that occurs through conversion of the setting of the confirmation grayscale voltage Vin2 that is used in the first-step grayscale interpolation period and the mobility correction period K1, the first-step grayscale electric potential that is used in the interpolation just after the conversion is controlled within the range of the setting values of the respective grayscale interpolation voltages Vin1 before and after the conversion of the grayscales. Accordingly, the gamma linearity is not greatly destroyed, the low cost is sought, and the high image quality can be realized (both cost reduction and high image quality can be realized).

<Electronic Appliances>

The display apparatus that adopts the grayscale interpolation process according to the embodiment of the invention including the organic EL display apparatus 1 as described above can be applied to display apparatuses of electronic appliances in all fields in which an image signal input to the electronic appliance or an image signal generated within the electronic appliance is displayed as a picture or an image. For example, the display apparatus may be applied to a portable music player using a recording medium, such as a semiconductor memory, a mini disk (MD), a cassette tape, and the like, a digital camera, a notebook type personal computer, a portable terminal device such as a portable phone, a display device such as a video camera, and the like.

In this case, the display apparatus may include a module shape of a sealed configuration. For example, the module may be a display module that is attached to and formed on an opposite portion of the pixel array unit 102 such transparent glasses or the like. On this transparent opposite portion, a color filter, a protection layer, or a shielding layer may be installed. In the display module, a circuit unit for inputting/outputting signals from the outside to the pixel array unit or an FPC (Flexible Print Circuit) may be installed.

Hereinafter, referring to FIGS. 6A to 6C, a detailed example of an electronic appliance on which the display apparatus adopting the grayscale interpolation process according to the embodiment of the invention is applied will be described.

Figure 6A:
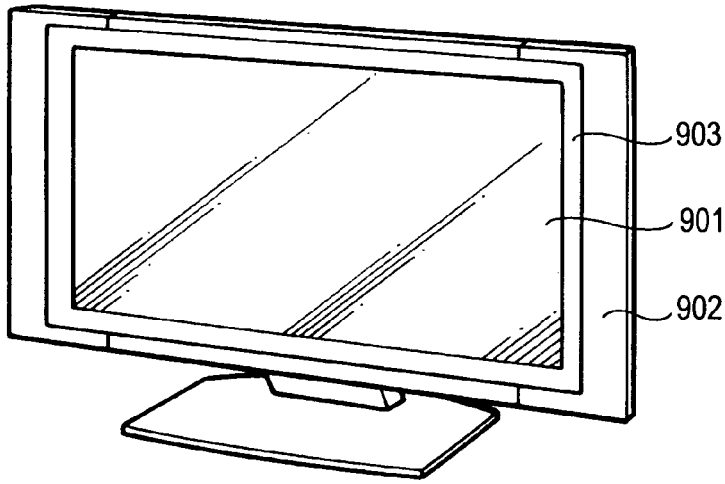
FIG. 6A is a diagram (1 of it) illustrating an example of an electronic appliance to which an embodiment of the invention is applied.
Figure 6A:
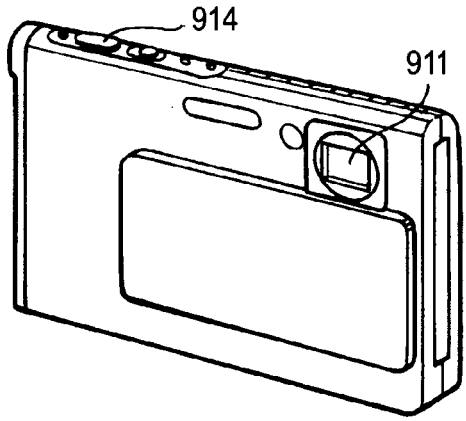
Figure 6A:
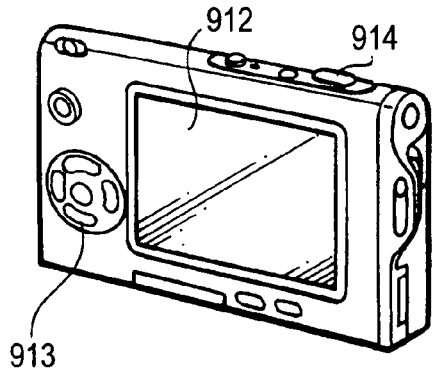

(1) of FIG. 6A is a perspective view illustrating an external appearance of a television set on which a display apparatus adopting the grayscale interpolation process is mounted according to the embodiment of the invention. The television set includes an image display screen unit 901 composed of a front panel 902 or a filter glass 903, and is manufactured using a display apparatus according to an embodiment of the invention as an image display screen unit 901.

(2) of FIG. 6A is a perspective view illustrating an external appearance of a digital camera on which the display apparatus that adopts the grayscale interpolation process according to the embodiment of the invention is mounted. (2-1) of FIG. 6A is a perspective view seen from the surface side, and (2-2) of FIG. 6A is a perspective view seen from the rear surface side. The digital camera according to this example includes a light-emitting unit 911 for flash, a display unit 912, a menu switch 913, a shutter button 914, and the like, and is manufactured using the display apparatus according to the embodiment of the invention as the display unit 912.

Figure 6B:
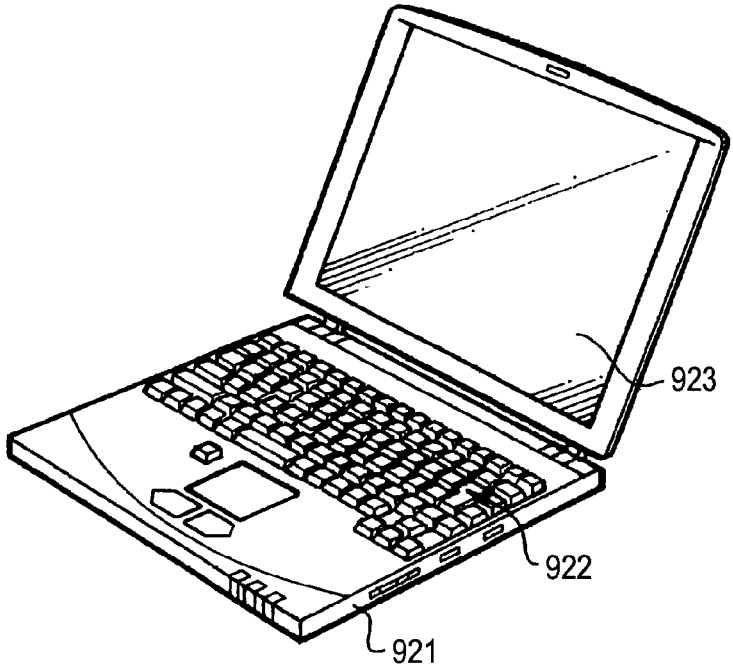
FIG. 6B is a diagram (2 of it) illustrating an example of an electronic appliance to which an embodiment of the invention is applied.
Figure 6B:
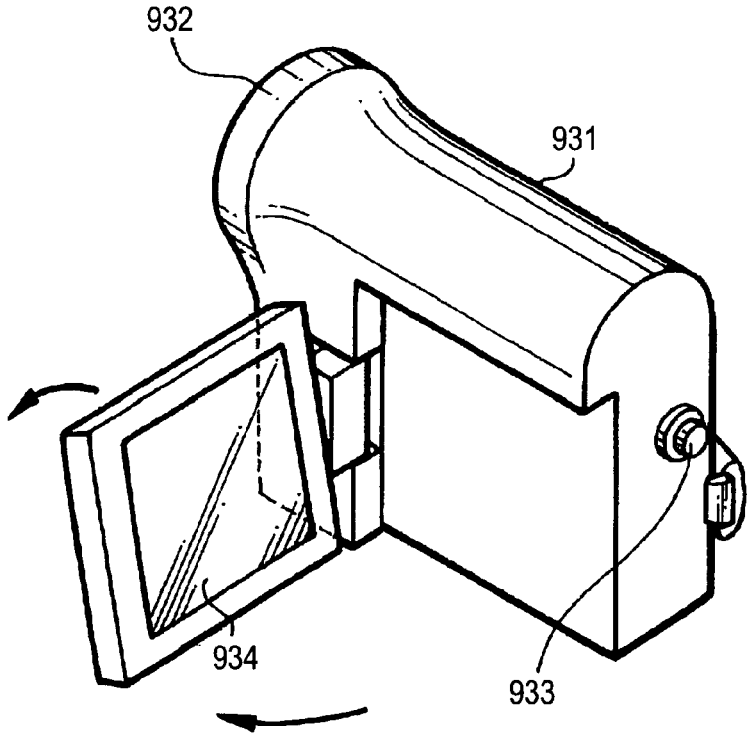

(1) of FIG. 6B is a perspective view illustrating an external appearance of a notebook type personal computer on which the display apparatus adopting the grayscale interpolation process according to the embodiment of the invention is mounted. The notebook type personal computer in this example includes a main body 921, a keyboard 922 that is operated when letters or figures are input, a display unit 923 displaying an image, and the like, and is manufactured using the display apparatus according to the embodiment of the invention as the display unit 923.

(2) of FIG. 6B is a perspective view illustrating an external appearance of a video camera on which the display apparatus adopting the grayscale interpolation process according to the embodiment of the invention is mounted. The video camera includes a main body unit 931, a lens 932 provided on the side surface toward a front direction, a start/stop switch 933 for photographing, a display unit 934, and the like, and is manufactured using the display apparatus according to the embodiment of the invention as the display unit 934.

Figure 6C:
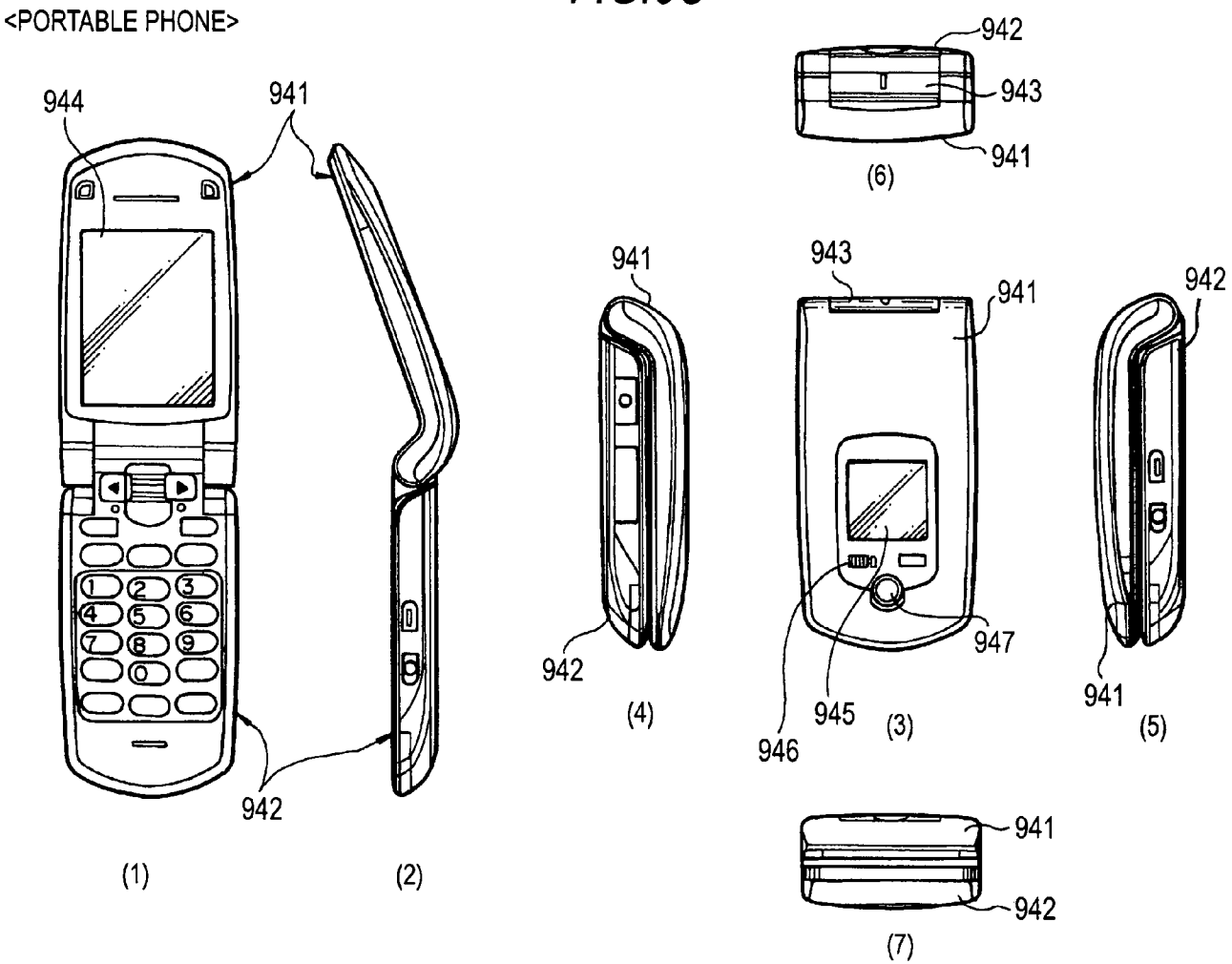
FIG. 6C is a diagram (3 of it) illustrating an example of an electronic appliance to which an embodiment of the invention is applied.

FIG. 6C is a view illustrating an external appearance of a portable phone (an example of a portable terminal device) on which the display apparatus adopting the grayscale interpolation process according to the embodiment of the invention is mounted. (1) of FIG. 6C is a front view in an open state, (2) of FIG. 6C is a side view, (3) of FIG. 6C is a front view in a closed state, (4) of FIG. 6C is a left side view, (5) of FIG. 6C is a right side view, (6) of FIG. 6C is a top view, and (7) of FIG. 6C is a bottom view. The portable phone according to this example includes an upper side housing 941, a lower side housing 942, a connection unit 943 (here, a hinge unit), a display 944, a sub-display 945, a picture light 946, a camera 947, and the like. Also, the portable phone according to this example is manufactured using the display apparatus according to the embodiment of the invention as the display 944 or the sub-display 945.

As described above, the embodiments of the invention have been described, but the technical scope of the invention is not limited to the range as described in the above-describe embodiments. Diverse modifications or improvements may be made without departing from the scope of the invention, and even such modifications or improvements are included in the technical range of the invention.

Also, the above-described embodiments do not limit the invention regarding claims, and the whole combinations of the features described in the embodiments may not be compulsory to the solving means of the invention. In the above-described embodiments, the invention of diverse steps is included, and diverse inventions may be extracted through an appropriate combination of the plurality of configuration conditions disclosed. Even if several configuration conditions are deleted from the whole configuration conditions disclosed in the embodiments, the configuration from which the several configuration conditions are deleted may be extracted as the invention so far as the effect is obtained.

<Modified Example of Pixel Circuit>

For example, it is possible to change the pixel circuit P on the side. For example, since principle of duality is formed on the circuit theory, the change of the pixel circuit P is possible on this viewpoint. In this case, although illustration is omitted, the pixel circuit P is configured using a p-type driving transistor 121 in contrast to the pixel circuit P configured using an n-type driving transistor 121. To meet this, the change according to the principle of duality is applied, such as the change of the polarity of the signal amplitude ΔVin for the offset electric potential Vofs of the image signal Vsig, the change of the size of the power supply voltages, and the like.

Even in the organic EL display device according to the modified example in which the driving transistor 121 has been changed to a p-type, in the same manner as the organic EL display apparatus having the n-type driving transistor 121, the threshold value correction operation, the mobility correction operation, and the bootstrap operation can be performed, and measures for low-resistance cathode wires can be applied thereto.

In the modified example of the pixel circuit P as described above, the change according to the "principle of duality" has been applied to the configuration according to the above-described embodiments. However, the technique of circuit change is not limited thereto. In performing the threshold value correction operation, the number of transistors that constitute the pixel circuit P is not concerned so far as the image signal Vsig for converting the offset electric potential Vofs and the signal electric potential Vin(=Vofs+ΔVin) in the horizontal period is driven to be transferred to the image signal line 106Hs to match the scanning operation of the write scanning unit 104, and the drain side (power supply side) of the driving transistor 121 performs a switching operation at the first and second electric potentials for the initialization operation of threshold value correction. Further, the number of transistors that constitute the pixel circuit P or the number of maintenance capacitances is disregarded. For example, the number of transistors may be three or more, and the grayscale control by the grayscale interpolation operation according to the embodiment of the invention may be applied to all of them.

Also, in performing the threshold correction operation, the configuration that supplies the offset electric potential Vofs and the signal electric potential Vin to the gate of the driving transistor 121 is not limited to the configuration coping with the image signal Vsig such as the 2TR configuration, and for example, as described in JP-A-2006-215213, a configuration that supplies the electric potential through a separate transistor may be adopted.

Even in the modified examples, in performing the grayscale control by the grayscale interpolation operation, the thought of the embodiments of the invention can be applied, which solves the problem in that the memory capacity is increased in a simple method by dividing the grayscales originally expressible into areas and using the common setting information for the respective areas.

The present application contains subject matter related to that disclosed in Japanese Priority Patent Application JP 2010-106922 filed in the Japan Patent Office on May 7, 2010, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus comprising:

a display panel unit in which electro-optical devices that emit display light are arranged in the form of a matrix; and a control unit performing display grayscale control by sequentially selecting the electro-optical devices are arranged and driving the selected electro-optical devices in order with a first signal voltage and a second signal voltage based on an image signal, wherein the control unit divides a grayscale range that can be expressed by the second signal voltage into a plurality of areas and performs a grayscale interpolation operation for interpolating the display grayscales by the electro-optical devices by setting voltage values of the first signal voltage and the second signal voltage according to the grayscales of the image signal as commonly using respective setting information of the first signal voltage for each divided area of the second signal voltage.

2. The display apparatus according to claim 1, wherein the display panel unit comprises pixel circuits, each of which includes a driving transistor generating a driving signal, the electro-optical device connected to an output terminal of the driving transistor, a maintenance capacitance maintaining information according to a signal amplitude of the image signal, and a sampling transistor writing the information according to the signal amplitude in the maintenance capacitance, arranged in the form of a matrix.

3. The display apparatus according to claim 1, wherein the control unit sets the first signal voltage to any one of a plurality of interpolated grayscale voltages according to the image signal, sets the second signal voltage as one basic grayscale voltage that corresponds to one grayscale of the plurality of grayscales that can be set by the image signal according to the image signal, and performs the grayscale interpolation operation between the one grayscale and a grayscale that is different from one corresponding grayscale by one step.

4. The display apparatus according to claim 1, wherein the control unit adjusts the voltage value of the first signal voltage that is used in interpolation before/after conversion within a range of setting information of the first signal voltage before the conversion of the grayscales and setting information of the first signal voltage after the conversion of the grayscales during the conversion of the one grayscale and the grayscale that is different from the one corresponding grayscale by one step.

5. The display apparatus according to claim 4, wherein the control unit uses a combination of the setting information of the first signal voltage before/after the conversion as the voltage value of the first signal voltage that is used in the interpolation before/after the conversion.

6. The display apparatus according to claim 4, wherein the control unit uses a value obtained by interpolating set values of the setting information of the first signal voltage before/after the conversion as the voltage value of the first signal voltage that is used in the interpolation before/after the conversion.

7. An electronic appliance comprising:

a display apparatus including a display panel unit in which electro-optical devices that emit display light are arranged in the form of a matrix, and a control unit performing display grayscale control by sequentially selecting the electro-optical devices and driving the selected electro-optical devices in order with a first signal voltage and a second signal voltage based on an image signal, wherein the control unit divides a grayscale range that can be expressed by the second signal voltage into a plurality of areas and performs a grayscale interpolation operation for interpolating the display grayscales by the electro-optical devices by setting voltage values of the first signal voltage and the second signal voltage according to the grayscales of the image signal as commonly using respective setting information of the first signal voltage for each divided area of the second signal voltage.

8. A method of driving a display apparatus performing a display grayscale control by sequentially selecting electro-optical devices of a display panel unit in which the electro-optical devices that emit display light are arranged in the form of a matrix and driving the selected electro-optical devices in order with a first signal voltage and a second signal voltage based on an image signal, the method comprising the steps of:

dividing a grayscale range that can be expressed by the second signal voltage into a plurality of areas, and performing a grayscale interpolation operation for interpolating the display grayscales by the electro-optical devices by setting voltage values of the first signal voltage and the second signal voltage according to the grayscales of the image signal as commonly using respective setting information of the first signal voltage for each divided area of the second signal voltage.

* * * * *